US008155552B2

(12) United States Patent
Kamimura

(10) Patent No.: US 8,155,552 B2
(45) Date of Patent: Apr. 10, 2012

(54) IMAGE FORMING APPARATUS FOR STABILIZING THE RELATIVE POSITION OF A BODY CASING AND A PHOTOSENSITIVE DRUM

(75) Inventor: Naoya Kamimura, Ichinomiya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 642 days.

(21) Appl. No.: 12/340,923

(22) Filed: Dec. 22, 2008

(65) Prior Publication Data

US 2009/0169235 A1 Jul. 2, 2009

(30) Foreign Application Priority Data

Dec. 28, 2007 (JP) ..... 2007-340756

(51) Int. Cl.

| | |
|---|---|
| ***G03G 15/00*** | (2006.01) |
| ***G03G 15/02*** | (2006.01) |
| ***G03G 21/16*** | (2006.01) |
| ***G03G 21/18*** | (2006.01) |

(52) U.S. Cl. ..... 399/90; 399/111; 399/116; 399/117; 399/113

(58) Field of Classification Search ..... 399/89, 399/90, 113

See application file for complete search history.

(56) References Cited

U.S. PATENT DOCUMENTS

| | | | | |
|---|---|---|---|---|
| 5,878,309 | A * | 3/1999 | Nomura et al. | 399/111 |
| 6,006,058 | A | 12/1999 | Watanabe et al. | |
| 6,029,032 | A | 2/2000 | Watanabe et al. | |
| 6,064,843 | A * | 5/2000 | Isobe et al. | 399/111 |
| 6,272,299 | B1 | 8/2001 | Numagami et al. | |
| 6,463,233 | B2 * | 10/2002 | Kojima et al. | 399/111 |
| 6,473,580 | B1 | 10/2002 | Inomata | |
| 2001/0041080 | A1 * | 11/2001 | Higeta et al. | 399/103 |
| 2002/0191981 | A1 * | 12/2002 | Miyabe et al. | 399/90 |
| 2003/0156848 | A1 * | 8/2003 | Kawai et al. | 399/27 |
| 2006/0008287 | A1 * | 1/2006 | Noda et al. | 399/90 |

(Continued)

FOREIGN PATENT DOCUMENTS

CN 1435735 A 8/2003

(Continued)

OTHER PUBLICATIONS

CN Office Action dtd Nov. 29, 2010, JP Appln. 2008-10190773.5, English translation.

(Continued)

*Primary Examiner* — David Gray
*Assistant Examiner* — David Bolduc
(74) *Attorney, Agent, or Firm* — Banner & Witcoff, Ltd.

(57) ABSTRACT

An image forming apparatus includes an image forming apparatus body including a driving force transmitting portion and a process cartridge. The process cartridge includes a housing, a photosensitive drum disposed in the housing, a first bearing rotatably supporting an axial end portion of the photosensitive drum, a driving force input portion, which is provided on the axial end portion of the photosensitive drum and is configured to engage the driving force transmitting portion in order to drive the photosensitive drum by a driving force transmitted from the driving force transmitting portion when the driving force transmitting portion is pressed against the driving force input portion, and a second bearing, which rotatably supports the other axial end of the photosensitive drum, and which comprises a first contact portion which contacts the image forming apparatus body when the driving force transmitting portion is pressed against the driving force input portion.

12 Claims, 17 Drawing Sheets

U.S. PATENT DOCUMENTS

| | | | | |
|---|---|---|---|---|
| 2006/0029421 | A1* | 2/2006 | Ishii et al. | 399/111 |
| 2007/0036582 | A1* | 2/2007 | Okabe | 399/111 |
| 2007/0147885 | A1 | 6/2007 | Okabe et al. | |
| 2007/0223962 | A1* | 9/2007 | Shiraki | 399/111 |

FOREIGN PATENT DOCUMENTS

| | | | |
|---|---|---|---|
| JP | 10-123915 | A | 5/1998 |
| JP | 10-153937 | | 6/1998 |
| JP | 11-202721 | | 7/1999 |
| JP | 2003-223091 | A | 8/2003 |
| JP | 2007-178657 | | 7/2007 |

OTHER PUBLICATIONS

Extended EP Search Report dtd Jan. 20, 2011, EP Appln. 08022067.6.

JP Office Action dtd Dec. 10, 2009, JP Appln. 2007-340756, partial English translation.

CN Office Action dtd Jun. 24, 2010, CN Appln. 200810190773.5, English translation.

JP Office Action dtd Sep. 7, 2010, JP Appln. 2007-340756, English translation.

* cited by examiner

IMAGE FORMING APPARATUS FOR STABILIZING THE RELATIVE POSITION OF A BODY CASING AND A PHOTOSENSITIVE DRUM

CROSS-REFERENCE TO RELATED APPLICATIONS

This application claims priority from Japanese Patent Application No. 2007-340756 filed on Dec. 28, 2007, the entire subject matter of which is incorporated herein by reference.

TECHNICAL FIELD

Aspects of the invention relate to an image forming apparatus.

BACKGROUND

As an example of an image forming apparatus that forms an image electrophotographically, JP-A-2007-178657 describes a color laser printer having a drum unit that is removably mounted to a body casing. The drum unit has a plurality of drum subunits provided in accordance with respective colors, and a pair of side plates with the drum subunits sandwiched therebetween. Each drum subunit has a photosensitive drum, and the photosensitive drum is positioned using the side plates.

Each side plate has a positioning shaft portion and a cutout portion. In addition, the body casing has a press arm and a reference shaft. In a state where the drum unit is mounted in the body casing, the positioning shaft portion is pressed against the press arm, and the cutout portion is in contact with the reference shaft. Therefore, the drum unit is positioned in the body casing.

SUMMARY

Illustrative aspects of the invention provide an image forming apparatus that can stabilize the relative position of a body casing and a photosensitive drum.

DETAILED DESCRIPTION

<General Overview>

Figure 1:
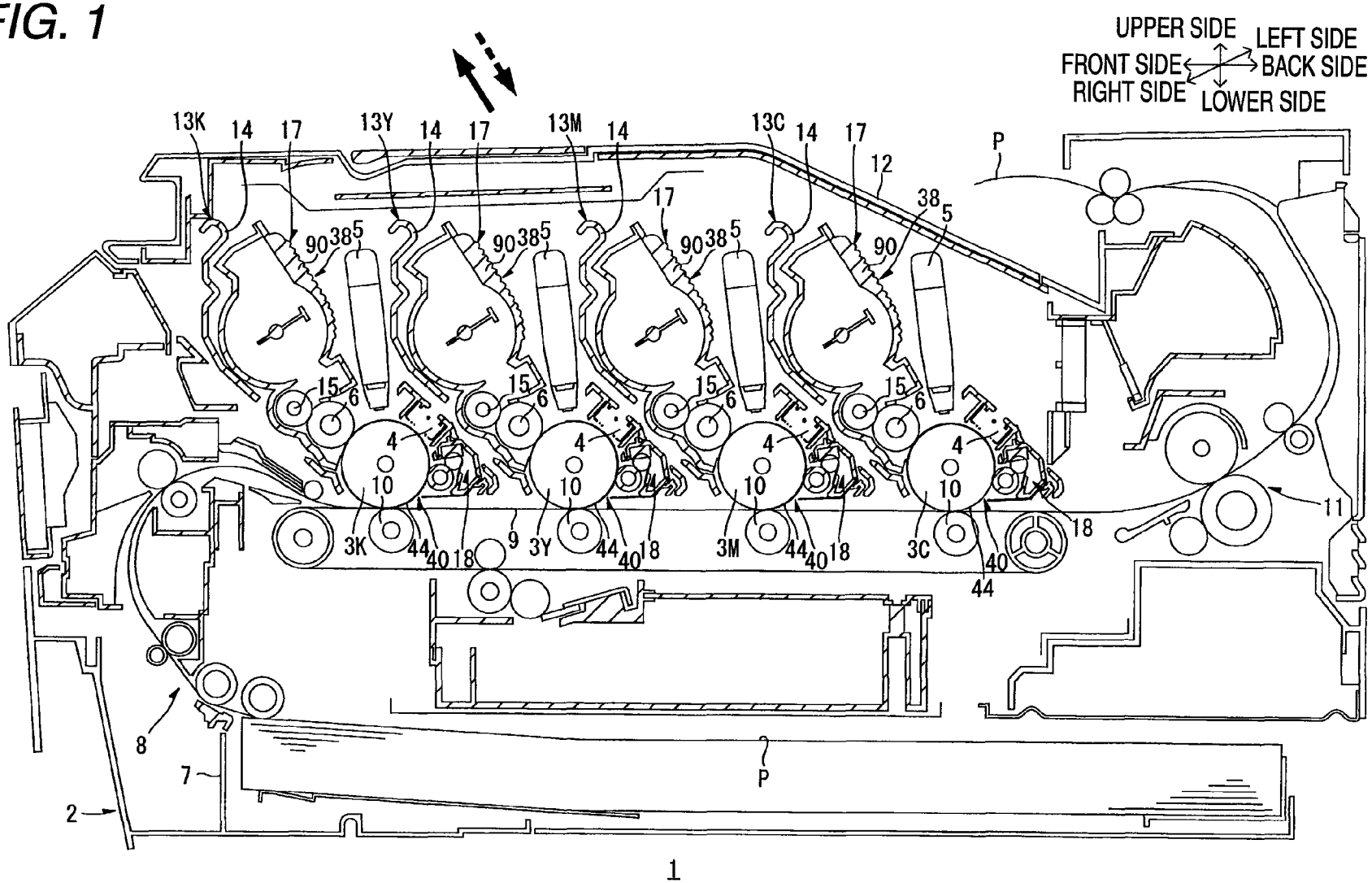
FIG. 1 is a side sectional view showing an image forming apparatus according to an exemplary embodiment of the invention.

In the related color laser printer, the photosensitive drum is positioned by the side plates (housing) of the drum unit, which is positioned in the body casing. That is, since the photosensitive drum is positioned in the body casing through the housing of the drum unit, it is not directly positioned in the body casing. For this reason, the positioning may be influenced by a tolerance of the housing of the drum unit. Thus, relative position of the body casing and the photosensitive drum may not be stabilized.

Accordingly, illustrative aspects of the invention provide an image forming apparatus that can stabilize the relative position of a body casing and a photosensitive drum.

According to a first illustrative aspect of the invention, there is provided an image forming apparatus comprising: an image forming apparatus body comprising a driving force transmitting portion; and a process cartridge that is removably mounted to the image forming apparatus body, wherein the process cartridge comprises: a housing; a photosensitive drum, which is disposed in the housing, and on which an electrostatic latent image is formed; a first bearing rotatably supporting an axial end portion of the photosensitive drum; a driving force input portion, which is provided on the axial end portion of the photosensitive drum and is configured to engage the driving force transmitting portion in order to drive the photosensitive drum by a driving force transmitted from the driving force transmitting portion when the driving force transmitting portion is pressed against the driving force input portion; and a second bearing, which rotatably supports the other axial end of the photosensitive drum, and which comprises a first contact portion which contacts the image forming apparatus body when the driving force transmitting portion is pressed against the driving force input portion.

According to a second aspect of the invention, there is provided a process cartridge for use in an image forming apparatus, the process cartridge comprising: a housing; a photosensitive drum that is disposed in the housing and on which an electrostatic latent image is formed; a first bearing that is provided at an axial end portion of the photosensitive drum and rotatably supports the axial end portion of the photosensitive drum; a driving force input portion, which is provided in the axial end portion of the photosensitive drum, which receives a driving force transmitted from the image forming apparatus and drives the photosensitive drum using the driving force; and a second bearing, which is provided at an other axial end of the photosensitive drum and rotatably supports the photosensitive drum, and which comprises a first contact portion that is pressed by the image forming apparatus when the driving force is transmitted from the image forming apparatus to the driving force input portion.

According to a third aspect of the invention, there is provided a process cartridge for use in an image forming apparatus, the process cartridge comprising: a housing; a photosensitive drum comprising: a shaft that extends through the photosensitive drum, the shaft having an inner member and an outer member; a photosensitive surface provided around a portion of the shaft and on which an electrostatic latent image is formed; a first bearing that has a ring-like shape and is provided around an axial end portion of the outer member of the shaft and rotatably supports the photosensitive drum; a driving force input portion, which has a ring-like shape and is provided around the axial end portion of the inner member of the shaft, which receives a driving force transmitted mechanically from the image forming apparatus to drive the photosensitive drum; a second bearing that has a ring-like shape and is provided around an other axial end of the inner member of the shaft and rotatably supports the photosensitive drum; a first contact portion that is formed at a distal end of the second bearing, the first contact portion being pressed against a wall of the housing when the driving force is transmitted from the image forming apparatus to the driving force input portion; and a cartridge electrode which is disposed on a radial surface of the other axial end of the photosensitive drum to receive a bias from the image forming apparatus.

According to the illustrative aspects of the invention, in the process cartridge, the one axial end portion of the photosensitive drum is rotatably supported by the first bearing, and the other axial end portion of the photosensitive drum is rotatably supported by the second bearing. In addition, in a state where the process cartridge is mounted in the image forming apparatus body, the driving force input portion, which is provided in the one axial end portion of the photosensitive drum, is connected to the driving force transmitting portion in the image forming apparatus body. Thus, the driving force for driving the photosensitive drum is transmitted from the driving force transmitting portion to the driving force input portion. At this time, the driving force input portion is pressed against the driving force transmitting portion, and accordingly the first contact portion of the second bearing is in contact with the image forming apparatus body. Therefore, the photosensitive drum which is supported by the second bearing is directly positioned in the image forming apparatus body, without passing through the housing of the process cartridge.

Accordingly, it is possible to stabilize the relative position of the photosensitive drum and the image forming apparatus body.

<Exemplary Embodiments>

Exemplary embodiments of the invention will be described with reference to the drawings.

(Image Forming Apparatus)

FIG. 1 is a side sectional view showing an image forming apparatus according to an exemplary embodiment of the invention. The directions in the following description reference the arrows shown in the FIG. 1 (the same is applied to other drawings). The right-left direction and the widthwise direction are the same.

A color printer is one example of the image forming apparatus 1. As shown in FIG. 1, the image forming apparatus 1 includes, in a body casing 2 as an example of an image forming apparatus body, four photosensitive drums 3 arranged in parallel in a front-back direction. In the following description, the four photosensitive drums 3 are referred to as a photosensitive drum 3K (black), a photosensitive drum 3C (cyan), a photosensitive drum 3M (magenta), and a photosensitive drum 3Y (yellow) according to respective colors (black, cyan, magenta, and yellow) of developer images formed on the individual photosensitive drums 3. A scorotron-type charger 4, a light emitting diode (LED) unit 5, a developing roller 6, and a cleaning member 18 are disposed to be opposed to each photosensitive drum 3.

The surface of the photosensitive drum 3 is uniformly charged by the charger 4, and then exposed by LEDs (not shown) provided in the LED unit 5. Then, an electrostatic latent image is formed on the photosensitive drum 3 on the basis image data. The electrostatic latent image is visualized by developer carried on the developing roller 6 corresponding to the photosensitive drum 3. Thus, a developer image is formed on the surface of the photosensitive drum 3.

A sheet P, as an example of a transfer medium, is stacked in a sheet feeding cassette 7 of the body casing 2. The sheet P stacked in the sheet feeding cassette 7 is turned from the front side to the back side by various rollers provided in a feeder unit 8 and then conveyed by a conveying belt 9. A conveying belt 9 is provided to correspond to the four photosensitive drums 3, that is, the photosensitive drums 3K, 3C, 3M, and 3Y. The conveying belt 9 is disposed between the corresponding photosensitive drum 3 and a transfer roller 10, which is disposed to be opposed to the photosensitive drum 3 from the below. Then, the developer images on the surfaces of the individual photosensitive drums 3 are transferred to the sheet P conveyed by the conveying belt 9 according to a transfer bias applied to the transfer rollers 10, and sequentially overlap on the sheet P.

The sheet P to which the developer images of the four colors are transferred is conveyed to a fixing part 11. The developer images transferred to the sheet P are thermally fixed by the fixing part 11. Thereafter, the sheet P is turned from the back side to the front side by various rollers and then discharged to a discharge tray 12.

At the time of image formation, after the developer image is transferred to the conveying belt 9 (i.e., onto the sheet P), foreign substances, such as untransferred developer on the photosensitive drum 3 or paper dust, are caught by a cleaning member 18 (the details of which will be described below).

(Process Cartridge)

The image forming apparatus 1 includes four process cartridges 13, as an example of a photosensitive cartridge, the four process cartridges 13 corresponding to the respective colors. In the following description, the four process cartridges 13 are referred to as a process cartridge 13K (black), a process cartridge 13Y (yellow), a process cartridge 13M (magenta), and a process cartridge 13C (cyan) according to the respective colors.

The process cartridges 13 are arranged in parallel along the front-back direction in the body casing 2. Specifically, for example, the process cartridges 13 are arranged in an order of the process cartridge 13K, the process cartridge 13Y, the process cartridge 13M, and the process cartridge 13C from the front side.

The process cartridges 13 are removably mounted in the body casing 2. Specifically, when the process cartridge 13 is removed, the body casing 2 is opened upward by displacing the discharge tray 12 located above the process cartridge 13, and then the process cartridge 13 is pulled up from the body casing 2 toward an obliquely upper front side (for the remove direction: see a thick solid-line arrow in the drawing). When the process cartridge 13 is mounted (i.e., installed), the body casing 2 is opened upward by displacing the discharge tray 12, and then the process cartridge 13 is pushed down toward an obliquely lower back side (for the mounting direction: see a thick dotted-line arrow in the drawing) and housed in the body casing 2. The four process cartridges 13 may be mounted/removed as a single body or may be separately mounted/removed.

(1) Process Casing

The process cartridge 13 includes a process casing 14 as an example of a housing. The process casing 14 has a box-like shape that longitudinally extends in the widthwise direction. In a state in which the process cartridge 13 is mounted in the body casing 2, process casing 14 is inclined toward the obliquely upper front side.

Figure 2A:
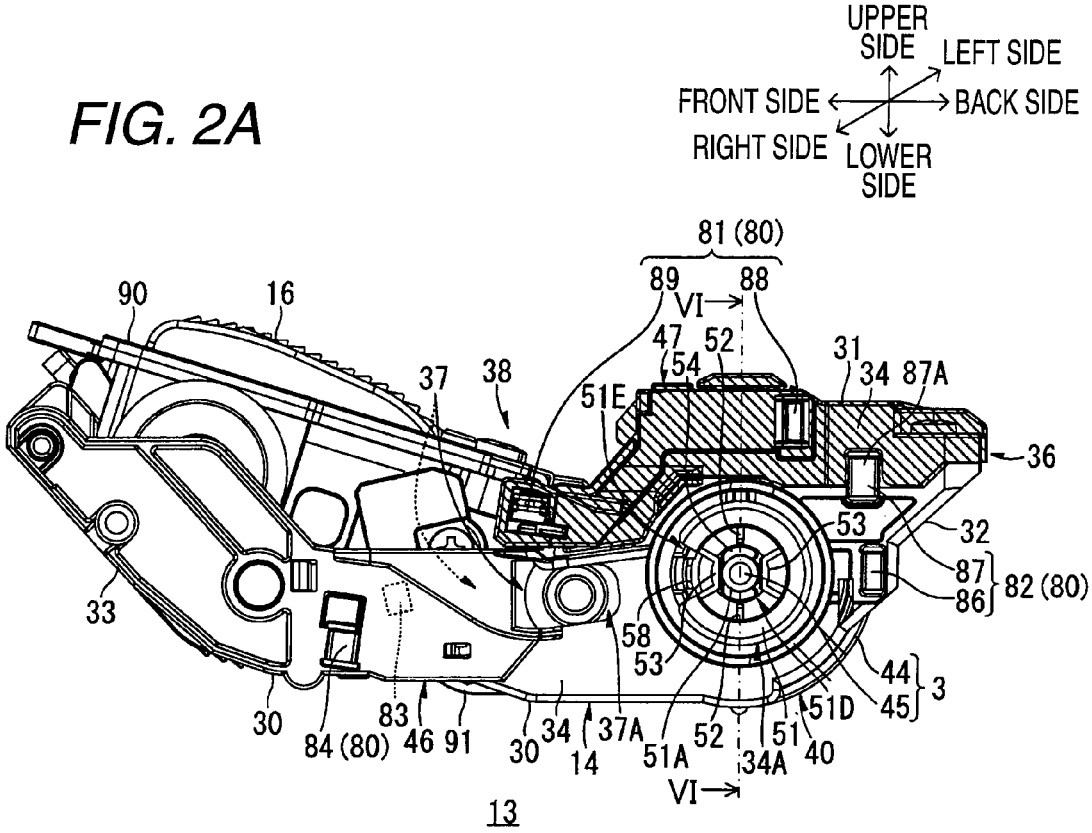
FIG. 2A is a right side view of a process cartridge of the image forming apparatus of FIG. 1.
Figure 2B:
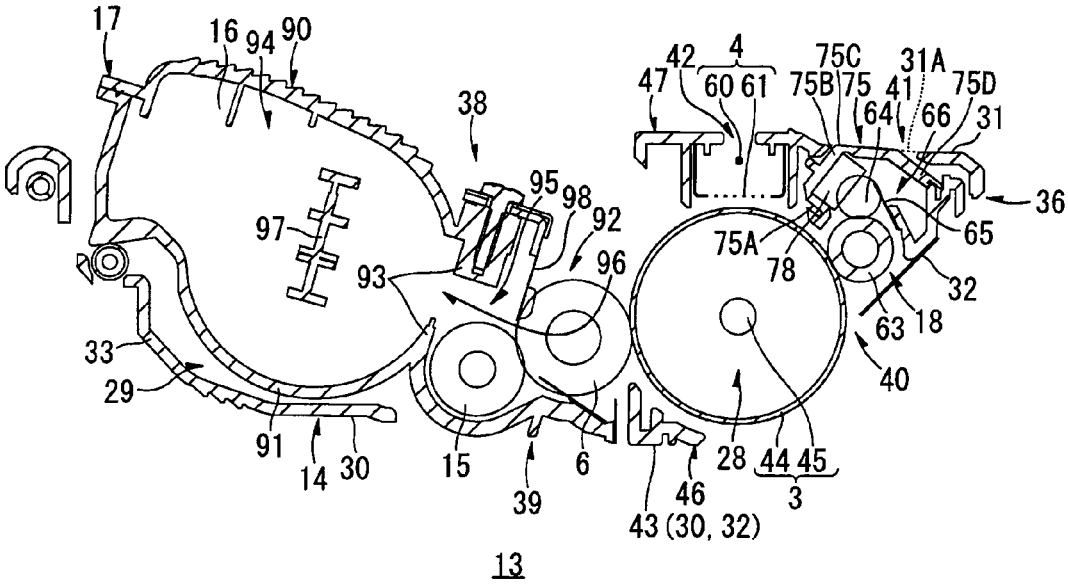
FIG. 2B is a central sectional view of the process cartridge.
Figure 3:
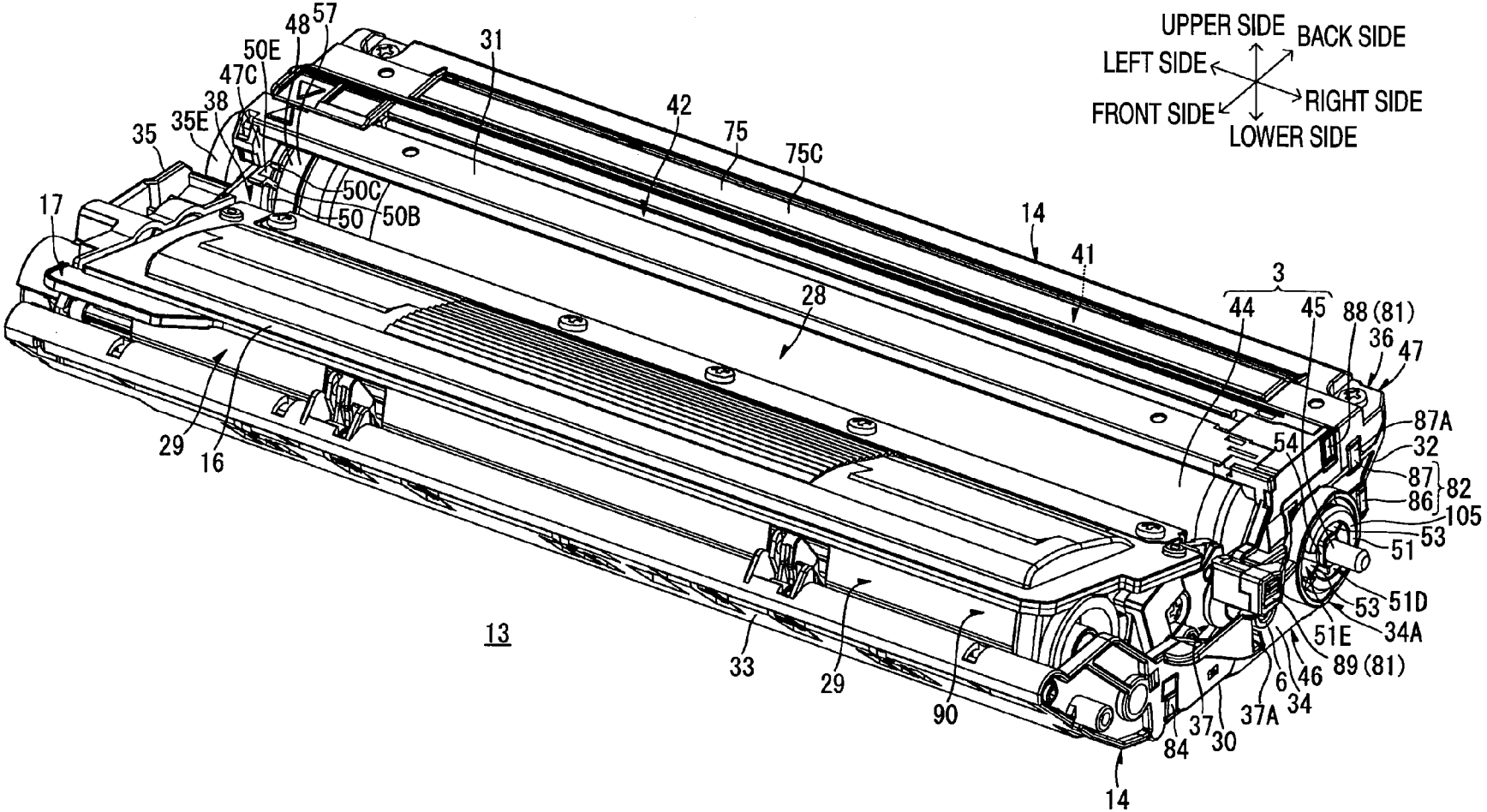
FIG. 3 is a perspective view of the process cartridge of FIG. 2A as viewed from an upper right side.
Figure 4:
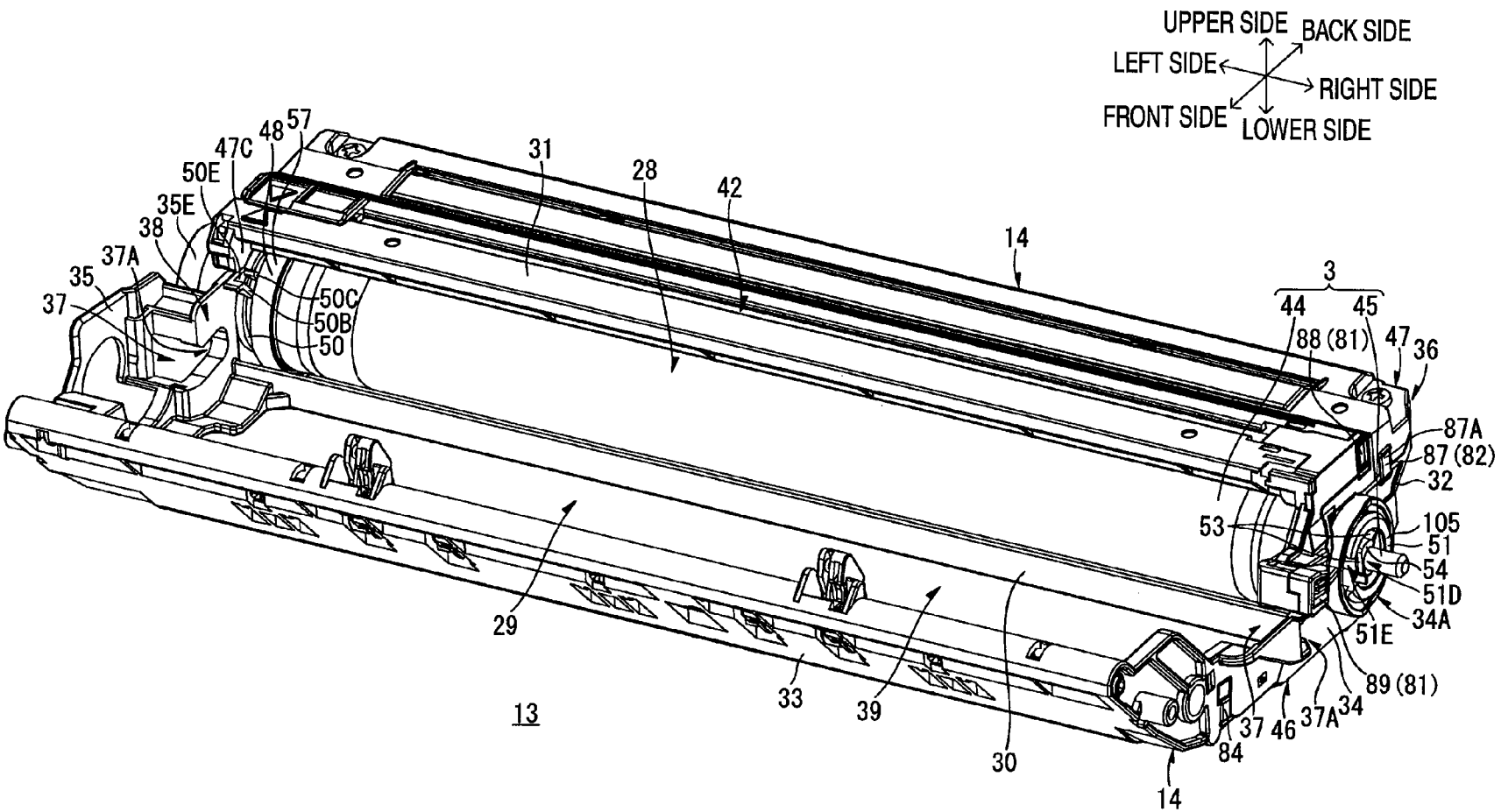
FIG. 4 shows a state in which a developing cartridge is removed from the process cartridge of FIG. 3.
Figure 5:
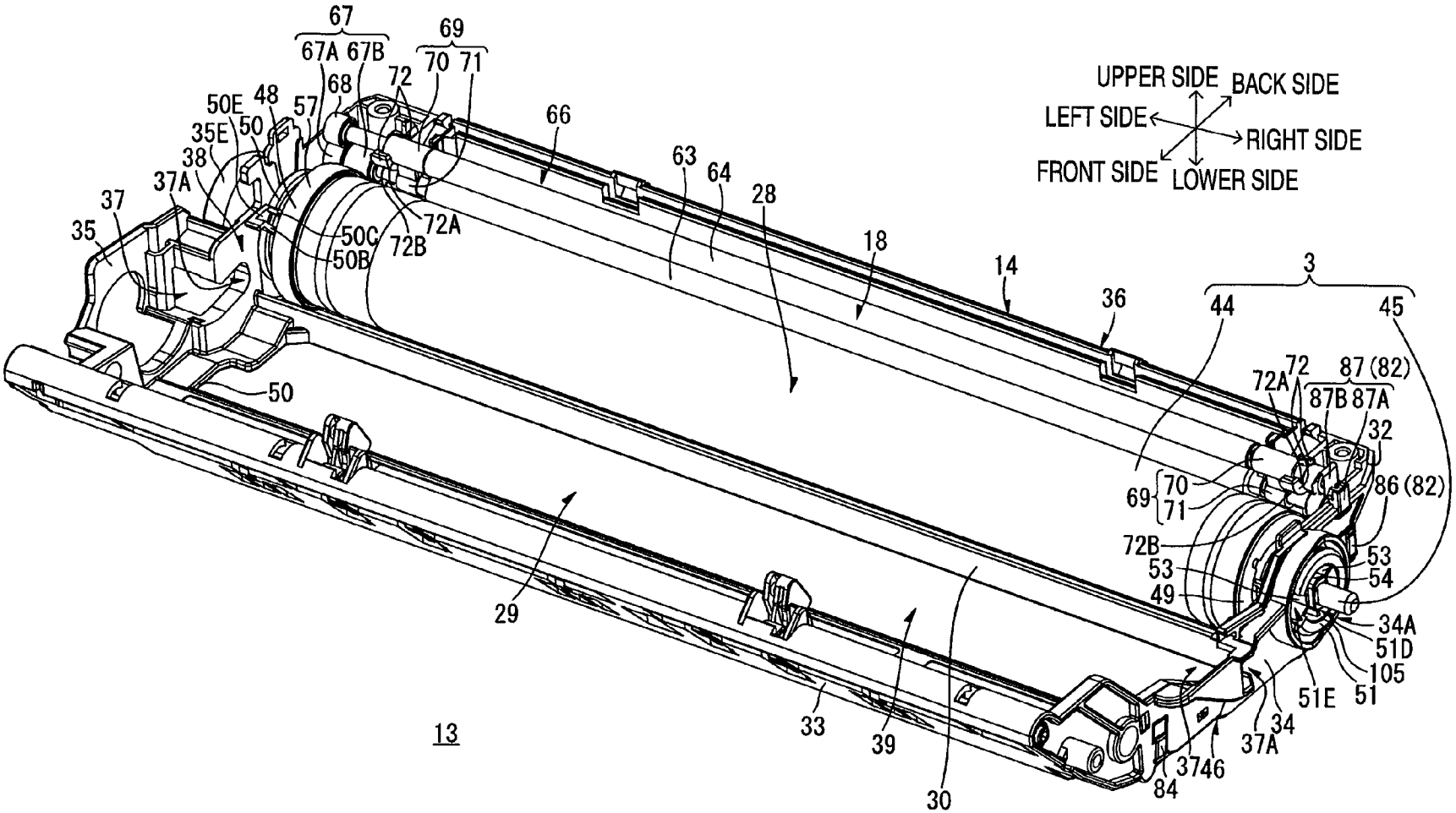
FIG. 5 shows a state in which a second casing is removed from the process cartridge of FIG. 4.

FIG. 2A is a left side view of a process cartridge of the image forming apparatus of FIG. 1. FIG. 2B is a central sectional view of the process cartridge. FIG. 3 is a perspective view of the process cartridge as viewed from an upper right side. FIG. 4 shows a state in which a developing cartridge is removed from FIG. 3. FIG. 5 shows a state in which a second casing is removed from FIG. 4.

In the following description, unless it is particularly described, the process cartridge 13 will be described under the assumption that the process cartridge 13 is removed from the body casing 2 and placed on a horizontal surface (a surface along the front-back direction), as shown in FIGS. 2A and 2B. The same assumed for describing a developing cartridge 17 described below.

The process cartridge 13 includes a process casing 14. The process casing 14 includes, as a single body, a first process wall 30, a second process wall 31, a third process wall 32, a fourth process wall 33, a fifth process wall 34, and a sixth process wall 35 as an example of a second contact portion. (Note that the sixth process wall 35 is shown in FIG. 3). The first process wall 30, the second process wall 31, the third process wall 32, the fourth process wall 33, the fifth process wall 34, and the sixth process wall 35 form an outer frame of the process casing 14.

The first process wall 30 has a longitudinal plate shape in the widthwise direction and extends along the front-back direction.

The second process wall 31 has a longitudinal plate shape in the widthwise direction and extends along the front-back direction. The second process wall 31 is opposed to the first process wall 30 (specifically, a back portion of the first process wall 30) at an interval from the above, and substantially extends in parallel with the first process wall 30.

The third process wall 32 has a longitudinal plate shape in the widthwise direction and continuously extends from a back end of the first process wall 30 toward an obliquely upper back side. A back end of the third process wall 32 is connected to a back end of the second process wall 31.

In the process casing 14, a portion sandwiched between the second process wall 31 and the third process wall 32 is tapered in a triangular shape toward a back side (a side which corresponds to a downstream side in the mounting direction) as viewed from the widthwise direction. A connection portion 36 of the back end of the third process wall 32 and the back end of the second process wall 31 is a back end portion in the process casing 14 (a portion which corresponds to a downstream-side end portion in the mounting direction).

The fourth process wall 33 has a longitudinal plate shape in the widthwise direction and continuously extends from a front end of the first process wall 30 toward the obliquely upper front side.

The fifth process wall 34 substantially has, as shown in FIG. 2A, a rectangular plate shape as viewed from the widthwise direction. The fifth process wall 34 is connected to the right ends of the first process wall 30, the second process wall 31, the third process wall 32, and the fourth process wall 33. At a left surface of the fifth process wall 34, a guide groove 37 is formed. The guide groove 37 extends from the center portion of an upper end of the fifth process wall 34 in the front-back direction toward the obliquely lower back side while being slightly bent. A back end portion of the guide groove 37 (hereafter referred to as an end point 37A) is an opening which is formed to pass through the fifth process wall 34 and is exposed on a right side from the fifth process wall 34.

The sixth process wall 35 shown in FIG. 3 substantially has the same shape as the fifth process wall 34, and is connected to the left ends of the first process wall 30, the second process wall 31, the third process wall 32, and the fourth process wall 33. At a right surface of the sixth process wall 35, similarly to the fifth process wall 34, a guide groove 37 is formed (see FIG. 4).

In such a process casing 14, as shown in FIG. 2B, a first opening 38, a second opening 39, a third opening 40, and a fourth opening 41 as an example of an opening, and a fifth opening 42 are formed.

The first opening 38 is an opening that substantially has a rectangular shape and is formed at an upper surface of the process casing 14. As shown in FIG. 4, the first opening 38 is defined by a front end of the second process wall 31, and upper ends of the fourth process wall 33, the fifth process wall 34, and the sixth process wall 35 in the process casing 14.

Figure 10:
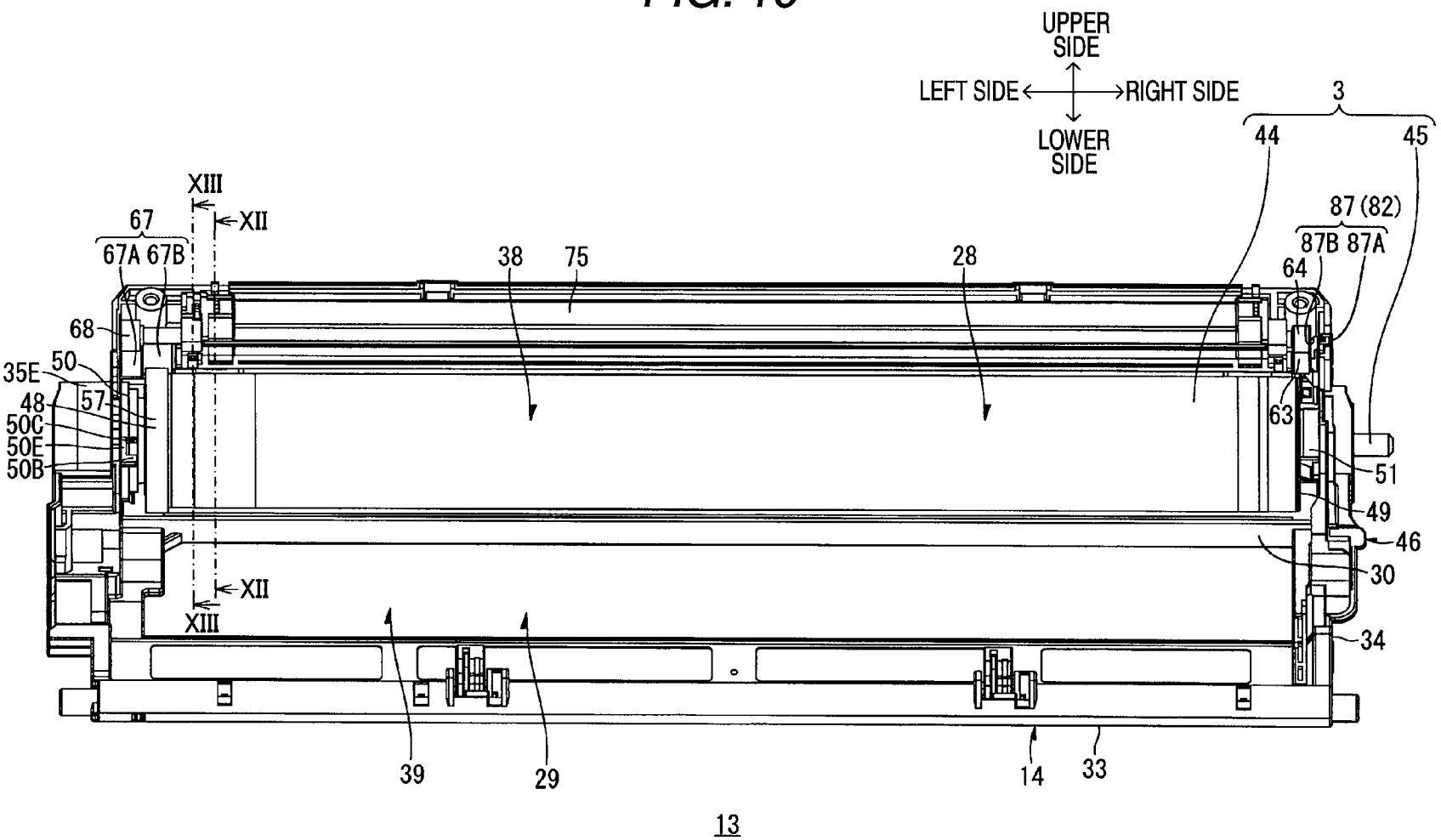
FIG. 10 is a diagram of a process cartridge having mounted thereon a cover as viewed from an upper front side.

As shown in FIG. 2B, the second opening 39 is an opening that substantially has a rectangular shape, and is formed in a back portion of the first process wall 30 (see also FIG. 10).

The third opening 40 is an opening that substantially has a rectangular shape, and is formed in a front-side region of the third process wall 32.

A portion of the first process wall 30 on the back side with respect to the second opening 39, and a portion in the third process wall 32 on the front side with respect to the third opening 40 are referred to as ribs 43. The ribs 43 extend in the widthwise direction between the second opening 39 and the third opening 40, and are provided between the fifth process wall 34 and the sixth process wall 35. The ribs 43 ensure sufficient strength of the process casing 14 between the second opening 39 and the third opening 40.

The fourth opening 41 and the fifth opening 42 are formed in the second process wall 31. The fourth opening 41 is provided off the connection portion 36 in a back half region of the second process wall 31 (specifically, on the front side with respect to the connection portion 36). The fifth opening 42 is provided on the front side with respect to the fourth opening 41. The fourth opening 41 and the fifth opening 42 are both longitudinal openings in the widthwise direction. In this exemplary embodiment, the fourth opening 41 is larger than the fifth opening 42 in the front-back direction.

Referring to FIG. 2A, the process casing 14 can be divided into a first casing 46 as an example of a first housing and a second casing 47 (a hatched portion in FIG. 2A) as an example of second housing.

The second casing 47 includes the second process wall 31, a back portion in an upper end portion of the fifth process wall 34 (a portion connected to the second process wall 31), and a back portion in an upper end portion of the sixth process wall 35 (a portion connected to the second process wall 31). As shown in FIG. 4, the second casing 47 has a reverse U-shaped lid-like shape as viewed from the front side.

The first casing 46 is a portion, excluding the second casing 47, in the process casing 14, and as shown in FIG. 5, has a dish-like shape having a substantially entirely opened upper surface. Of the opened portion at the upper surface of the first casing 46, a front half portion is the first opening 38 (see FIG. 4).

In the process casing 14, the photosensitive drum 3, the charger 4, the developing roller 6, a supply roller 15, a toner hopper 16 for accommodating developer, and a cleaning member 18 are primarily disposed, as shown in FIG. 2B. The center axis (rotation axis) of each of the photosensitive drum 3, the developing roller 6, and the supply roller 15 extends along the widthwise direction. In the process cartridge 13, the developer accommodated in the toner hopper 16 is supplied to the developing roller 6 by the supply roller 15, and as described above, carried on the developing roller 6.

The developing roller 6, the supply roller 15, and the toner hopper 16 are provided in the form of a separate unit, and are removably mounted in the process casing 14 as the developing cartridge 17. The developing cartridge 17 is mounted to and removed from the body casing 2 along with the process casing 14 (that is, as a portion of the process cartridge 13) (see FIG. 1). In addition, the developing cartridge 17 may be separately mounted to and removed from the body casing 2 in a state in which the process casing 14 is mounted on the body casing 2. The developing cartridge 17 develops the electrostatic latent image on the photosensitive drum 3. The developing cartridge 17 will be described below in detail.

The inner space of the process casing 14 is divided into a first space 28 where the photosensitive drum 3, the charger 4, and the cleaning member 18 are disposed, and a second space 29 where the developing cartridge 17 is disposed. The second space 29 is connected to the first space 28 and is located on the front side of the first space 28. The second space 29 communicates with the first opening 38 on the upper side, and communicates with the second opening 39 on the lower side. At a boundary portion between the first space 28 and the second space 29 (specifically, in FIG. 2B, a portion corresponding to a periphery of a back end of the first opening 38), a front end portion of the LED unit 5 (a portion that emits light to expose the photosensitive drum 3) is disposed (see FIG. 1).

(2) Photosensitive Drum

Figure 6:
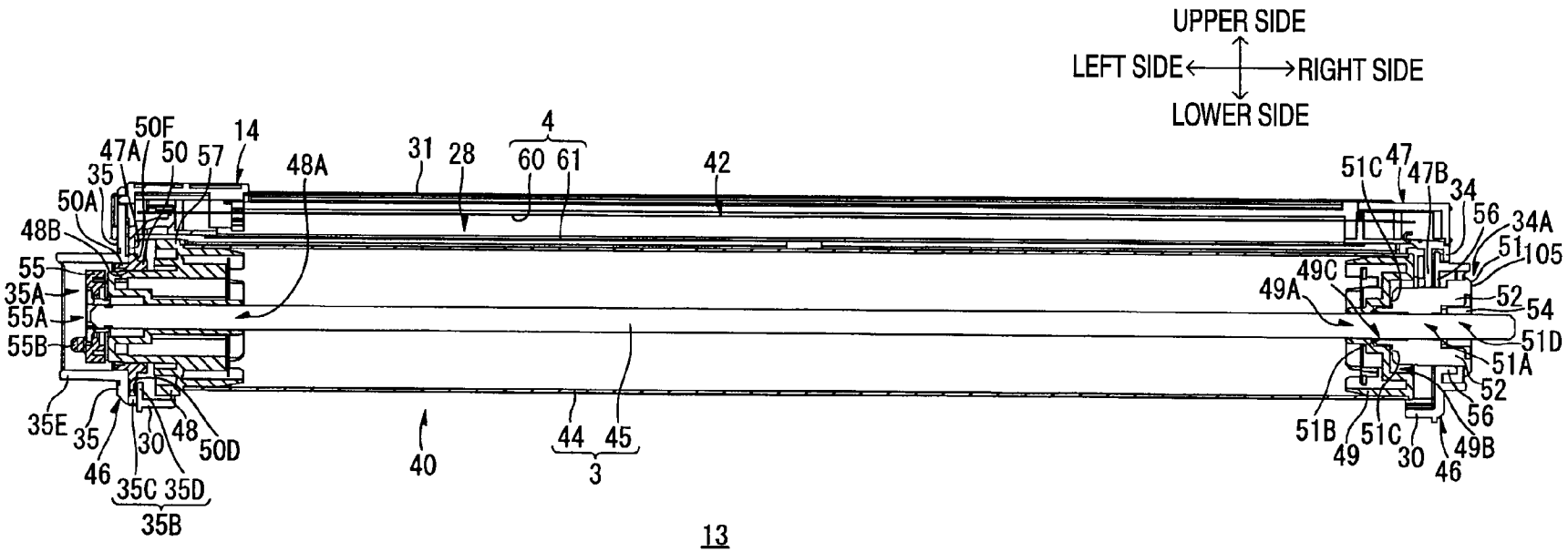
FIG. 6 is a sectional view taken along the line VI-VI of FIG. 2A.
Figure 7A:
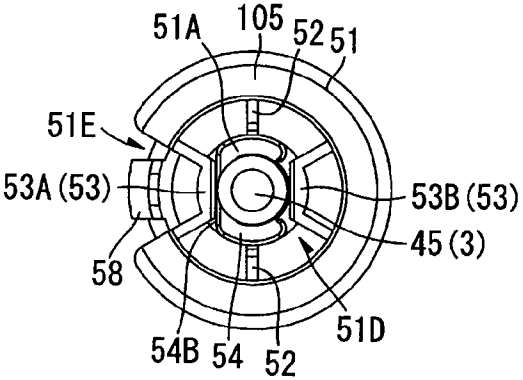
FIG. 7A is a diagram showing a right bearing, a drum shaft, and a fastener excerpted from FIG. 2A.
Figure 7B:
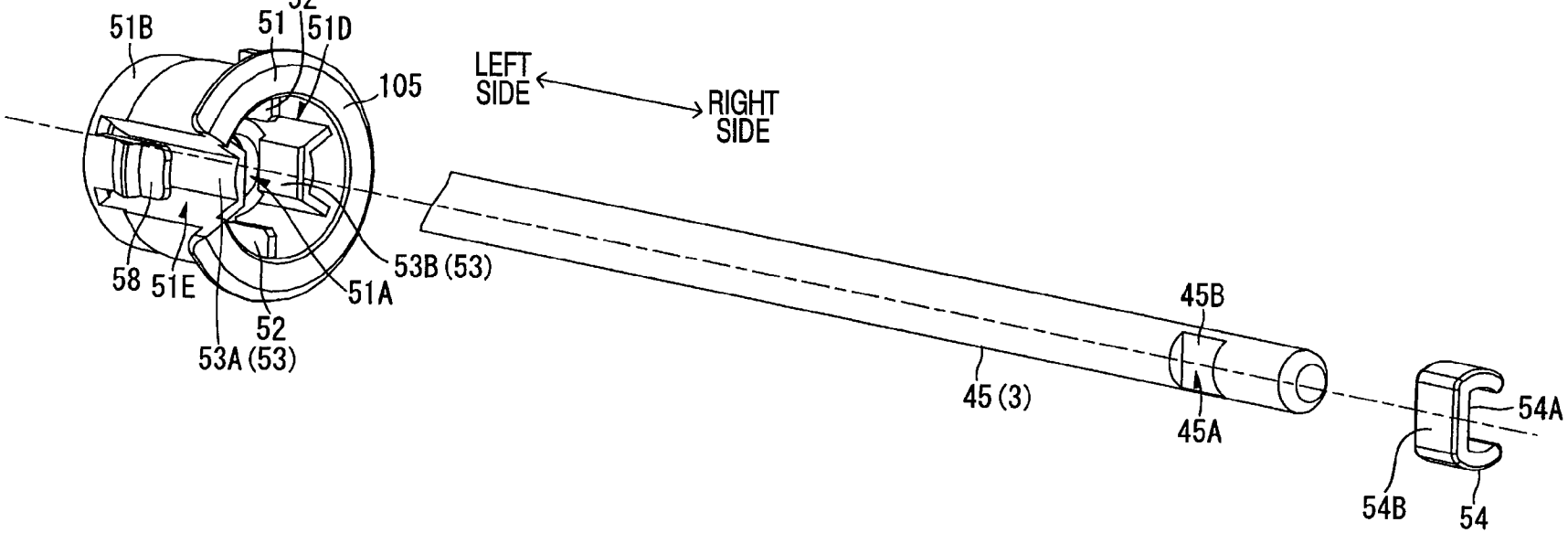
FIG. 7B is an exploded perspective view corresponding to FIG. 7A.

FIG. 6 is a sectional view taken along the line VI-VI of FIG. 2A. FIG. 7A is a diagram showing a right bearing, a drum shaft, and a fastener excerpted from FIG. 2A. FIG. 7B is an exploded perspective view corresponding to FIG. 7A.

The photosensitive drum 3 is disposed in the first space 28 and supported by the first casing 46. The photosensitive drum 3 includes a drum body 44 and a drum shaft 45.

As shown in FIG. 6, the drum body 44 has a hollow cylindrical shape, and an outermost layer of the drum body 44 is formed of a photosensitive layer. The center axis extends along the widthwise direction. On the surface of the drum body 44, the electrostatic latent image is formed. A portion of the surface (i.e., an outer peripheral surface) of the drum body 44 is exposed on the transfer roller 10 side through the third opening 40 (see FIGS. 1 and 2B).

To a left end portion of the drum body 44 (which also corresponds to a left end portion of the photosensitive drum 3), a left flange 48 is attached. The left flange 48 has a hollow cylindrical shape, which is shorter than the drum body 44 in the widthwise direction. The center axis of the left flange 48 extends along the widthwise direction. The left flange 48 is pressed into the left end portion of the drum body 44, and a right portion of an outer peripheral surface of the left flange 48 is pressed into contact with an inner peripheral surface of the left end portion of the drum body 44. Therefore, the left flange 48 is relatively unmovable with respect to the drum body 44 (the photosensitive drum 3). A hollow portion of the left flange 48 is a circular hole that passes through a circular center portion of the left flange 48 along the widthwise direction. The hollow portion of the left flange 48 becomes a left through hole 48A. The left end portion of the left flange 48 becomes a diameter-reduced portion 48B, and an outer peripheral surface of the diameter-reduced portion 48B is reduced in diameter, as compared with an outer peripheral surface of a portion on the right side with respect to the left end portion. On the outer peripheral surface of the left flange 48, gear teeth are formed in a portion on the right side with respect to the diameter-reduced portion 48B and on the right side with respect to the drum body 44 (corresponds to a peripheral surface of the left end portion of the photosensitive drum 3). The portion having the gear teeth is a first gear 57 (see FIG. 5).

At a left end surface of the left flange 48, a driving force receiving portion 55 as an example of a driving force input portion is provided. The driving force receiving portion 55 has a disc-like shape, which substantially has the same diameter as the diameter-reduced portion 48B, and in the circular center portion thereof, a circular through hole 55A is formed. The through hole 55A substantially has the same diameter as the left through hole 48A. At a left end surface of the driving force receiving portion 55, a plurality of protrusions 55B are provided. For example, in this exemplary embodiment, two protrusions 55B are provided (see FIG. 17). The plurality of protrusions 55B are disposed with the through hole 55A interposed therebetween in left side view, and protrude leftward.

To a right end portion of the drum body 44 (which also corresponds to a right end portion of the photosensitive drum 3), a right flange 49 as an example of a flange is attached. The right flange 49 has a hollow cylindrical shape, which is shorter than the drum body 44 in the widthwise direction. The center axis of the right flange 49 extends along the widthwise direction. The right flange 49 is pressed into the right end portion of the drum body 44, and the entire outer peripheral surface of the right flange 49 is pressed into contact with the right end portion of the drum body 44. Therefore, the right flange 49 is relatively unmovable with respect to the drum body 44 (the photosensitive drum 3). A hollow portion of the right flange 49 is a circular hole that passes through a circular center portion of the right flange 49 along the widthwise direction. The hollow portion of the right flange 49 becomes a right through hole 49A. The right through hole 49A substantially has the same diameter as the left through hole 48A. At a right end surface of the right flange 49, a first concave portion 49B is formed to be depressed leftward. The first concave portion 49B has a cylindrical shape that is concentric with the right through hole 49A. In an innermost portion (left end portion) of the first concave portion 49B, a second concave portion 49C is formed to be further depressed leftward. The second concave portion 49C has a cylindrical shape that is concentric with the right through hole 49A, and is smaller than the first concave portion 49B.

As such, the drum body 44, the left flange 48, the right flange 49, and the driving force receiving portion 55 are made as a single body.

The drum shaft 45 has an elongated cylindrical shape that extends along the widthwise direction. The drum shaft 45 has a diameter slightly smaller than the left through hole 48A of the left flange 48. The drum shaft 45 is loosely fitted into the left through hole 48A, the through hole 55A of the driving force receiving portion 55, and the right through hole 49A of the right flange 49. In this state, the drum body 44, the left flange 48, the right flange 49, and the driving force receiving portion 55 as a single body are relatively movable with respect to the drum shaft 45.

As shown in FIG. 7B, a cutout 45A is formed in the right end portion of the drum shaft 45. The cutout 45A is formed by partially cutting the outer peripheral surface of the drum shaft 45. In the drum shaft 45, a portion where the cutout 45A is formed substantially has a semicircular shape (i.e., a D-like shape) in section. That is, in the cutout 45A, a flat surface 45B is formed to extend along the widthwise direction on the inward side with respect to the outer peripheral surface of the drum shaft 45.

In connection with the photosensitive drum 3, as shown in FIG. 6, a left bearing 50 as an example of a first bearing and a right bearing 51 as an example of a second bearing are provided in the process cartridge 13.

(3) Left Bearing

Figure 8B:
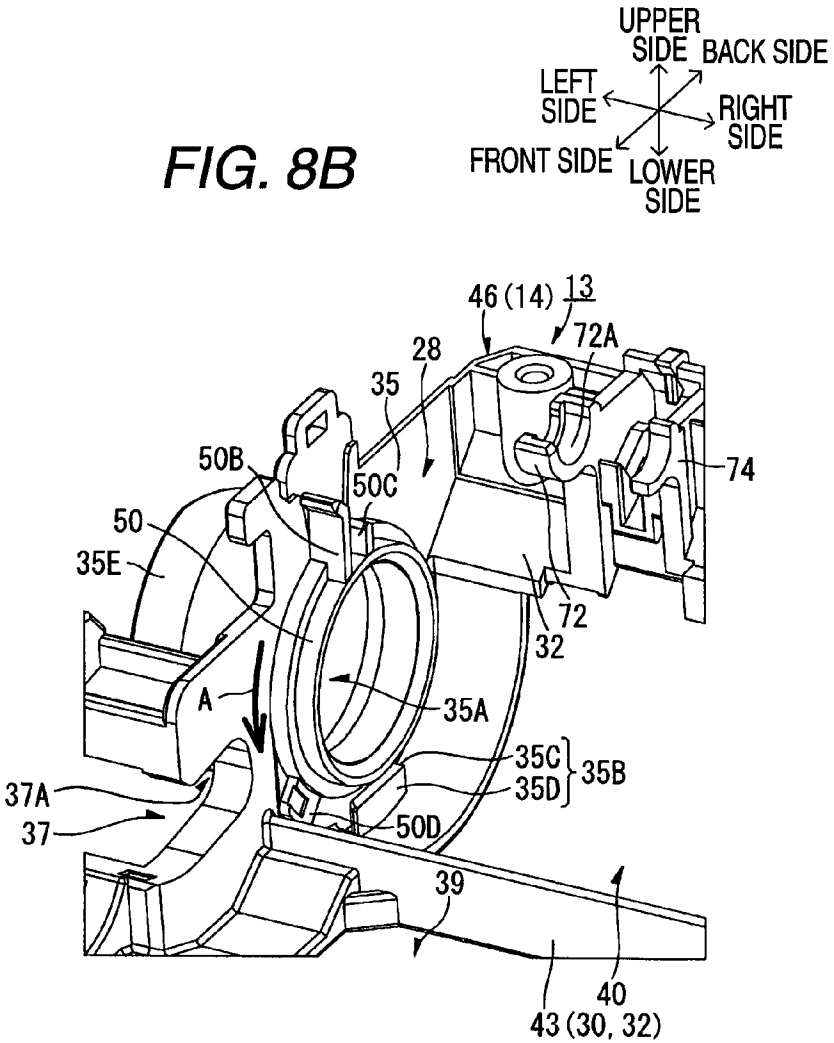
FIG. 8B is a diagram showing a state in which a left bearing is exposed from FIG. 8A.
Figure 8A:
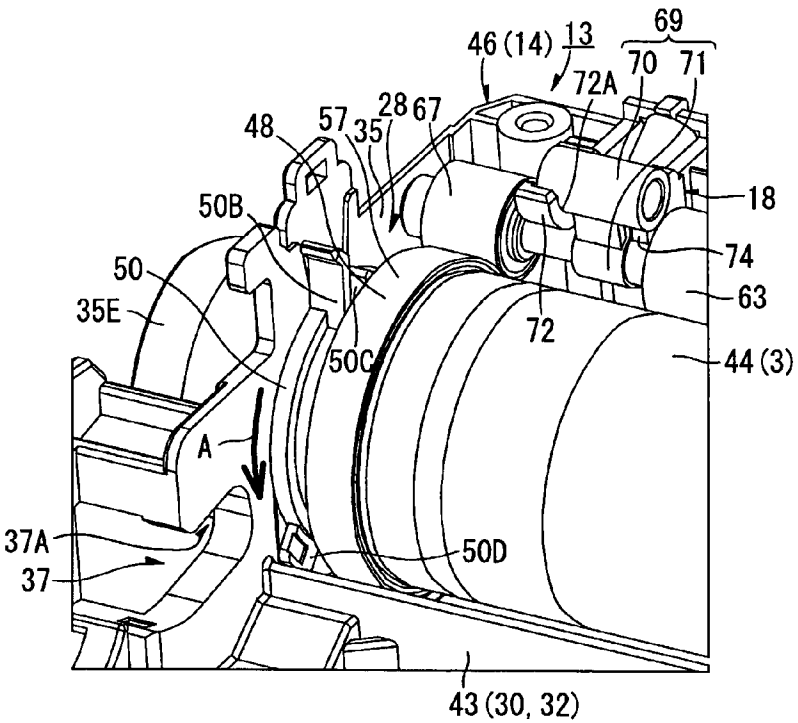
FIG. 8A is an enlarged view of a portion of FIG. 5, and shows a state in which a third convex portion is not engaged with a first casing.
Figure 9B:
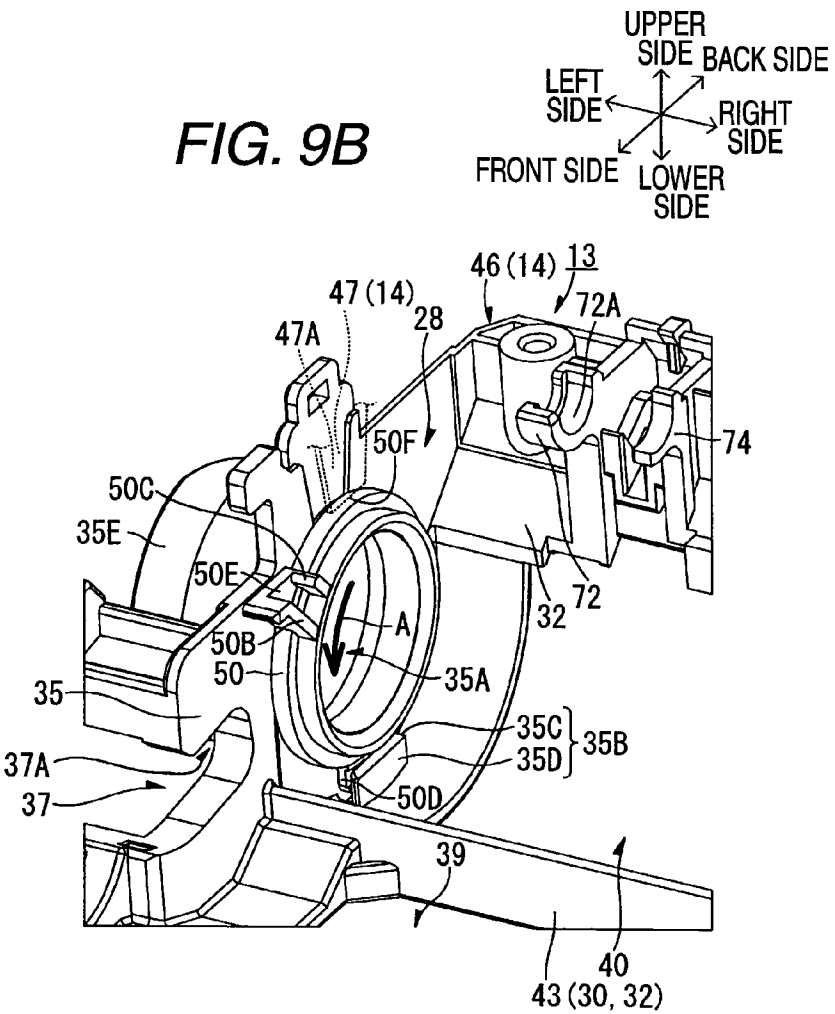
FIG. 9B shows a state in which the left bearing is rotated in the first direction from FIG. 8B.
Figure 9A:
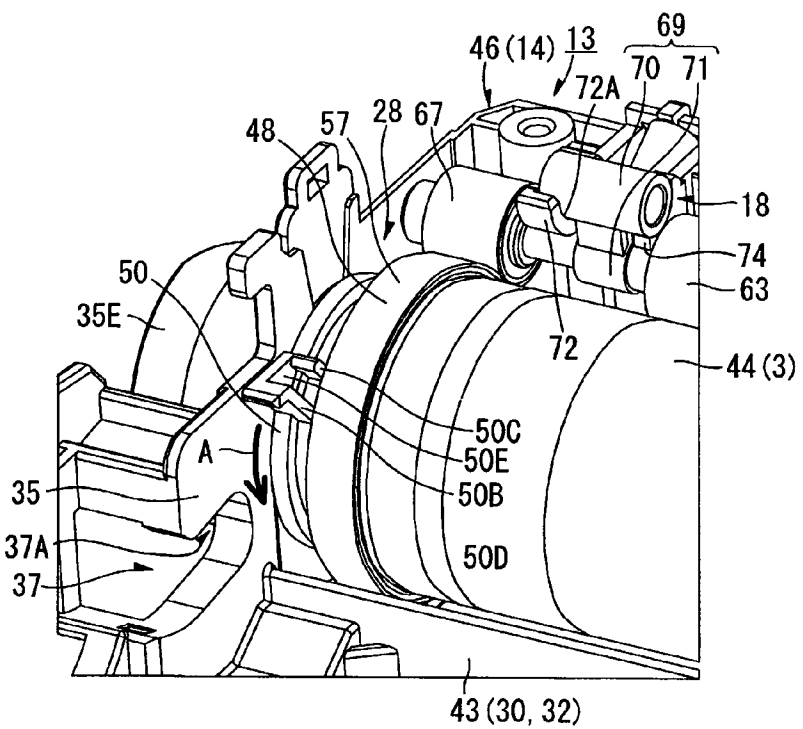
FIG. 9A shows a state in which the left bearing is rotated in a first direction from FIG. 8A.

FIG. 8A is an enlarged view of a portion of FIG. 5 and shows a state in which a third convex portion is not engaged with a first casing. FIG. 8B is a diagram showing a state in which a left bearing is exposed from FIG. 8A. FIG. 9A shows a state in which a left bearing is rotated in a first direction from FIG. 8A. FIG. 9B shows a state in which a left bearing is rotated in a first direction from FIG. 8B.

The left bearing 50 substantially has a ring-like shape. In the left bearing 50, a left end portion 50A is reduced in diameter, as compared with a portion on the right side with respect to the left end portion 50A. At an outer peripheral surface of the portion on the right side with respect to the left end portion 50A in the left bearing 50, as shown in FIG. 8B, a first convex portion 50B, a second convex portion 50C, and a third convex portion 50D as an example of an engaging portion are provided.

The first convex portion 50B and the second convex portion 50C have a slightly thick plate-like shape in the widthwise direction, and are provided close to each other. The first convex portion 50B and the second convex portion 50C protrude from an outer peripheral surface of the left bearing 50 to the outside in a radial direction. The first convex portion 50B protrudes farther than the second convex portion 50C. A front end portion (i.e., a front end portion (distal end portion) of the first convex portion 50B) is bent in a direction apart from a front end portion of the second convex portion 50C. The front end portion of the first convex portion 50B and the front end portion of the second convex portion 50C are connected with each other by a connection portion 50E (see FIG. 9B). The connection portion 50E is inclined along the bent front end portion of the first convex portion 50B.

The third convex portion 50D has a thin plate-like shape in the widthwise direction, and is substantially provided on a side opposite to the first convex portion 50B (e.g., at a position shifted by approximately 140° in a circumferential direction) on the outer peripheral surface of the left bearing 50.

In connection with the left bearing 50, a through hole is formed in a portion opposed to the photosensitive drum 3 in the widthwise direction at a left sidewall (i.e., the sixth process wall 35) of the first casing 46 of the processing casing 14. The through hole is a left exposure hole 35A. The left exposure hole 35A is a circular hole that has a diameter larger than the outer diameter of the left end portion 50A of the left bearing 50 (see FIG. 6). At a left surface of the sixth process wall 35, a left rib 35B as an example of a first regulating portion is provided below the left exposure hole 35A. The left rib 35B includes, as a single body, a first portion 35C that extends rightward from a right surface of the sixth process wall 35, and a second portion 35D that is bent from the right end portion of the first portion 35C toward the front side. At the left surface of the sixth process wall 35, a cylindrical boss 35E is provided to surround the left exposure hole 35A and protrude leftward.

The left bearing 50 is attached to the first casing 46. When the left bearing 50 is attached, the left end portion 50A of the left bearing 50 is fitted into the left exposure hole 35A (see FIG. 6). At this time, a portion in the left bearing 50 on the right side with respect to the left end portion 50A is not in contact with the left rib 35B, and the third convex portion 50D is located on the obliquely upper front side with respect to the left rib 35B. The first convex portion 50B and the second convex portion 50C extend upward. Then, the left bearing 50 is rotated so as to press the first convex portion 50B and the second convex portion 50C in a direction in which the third convex portion 50D approximates to the left rib 35B (i.e., a first direction A indicated by a thick solid-line arrow in FIGS. 8A and 8B). Thereafter, as shown in FIG. 9B, if the third convex portion 50D is disposed between the second portion 35D of the left rib 35B and the sixth process wall 35, and is in contact with the first portion 35C of the left rib 35B, the third convex portion 50D is engaged with the first casing 46 at the left rib 35B, and the rotation of the left bearing 50 is stopped. In this way, attachment of the left bearing 50 is completed.

In this state, since the third convex portion 50D is disposed between the second portion 35D of the left rib 35B and the sixth process wall 35, the left bearing 50 is positioned in the widthwise direction. In addition, since the third convex portion 50D is in contact with the first portion 35C of the left rib 35B, further rotation of the left bearing 50 in the first direction A is regulated. The first convex portion 50B and the second convex portion 50C are inclined to the front side such that the connection portion 50E follows the nearest upper end of the first casing 46.

As shown in FIG. 6, the diameter-reduced portion 48B of the left flange 48 is inserted into the hollow portion of the left bearing 50 to which the first casing 46 is attached. Accordingly, the left flange 48, that is, the left end portion of the photosensitive drum 3 is rotatably supported by the left bearing 50. When the photosensitive drum 3 rotates, the outer peripheral surface of the diameter-reduced portion 48B of the left flange 48 comes into slide contact with an inner peripheral surface of the left bearing 50. In this state, movement of the left flange 48 in the widthwise direction with respect to the left bearing 50 is permitted. In the first casing 46, the left end surface of the driving force receiving portion 55 is exposed on the left side of the first casing 46 through the left exposure hole 35A of the sixth process wall 35.

Figure 19:
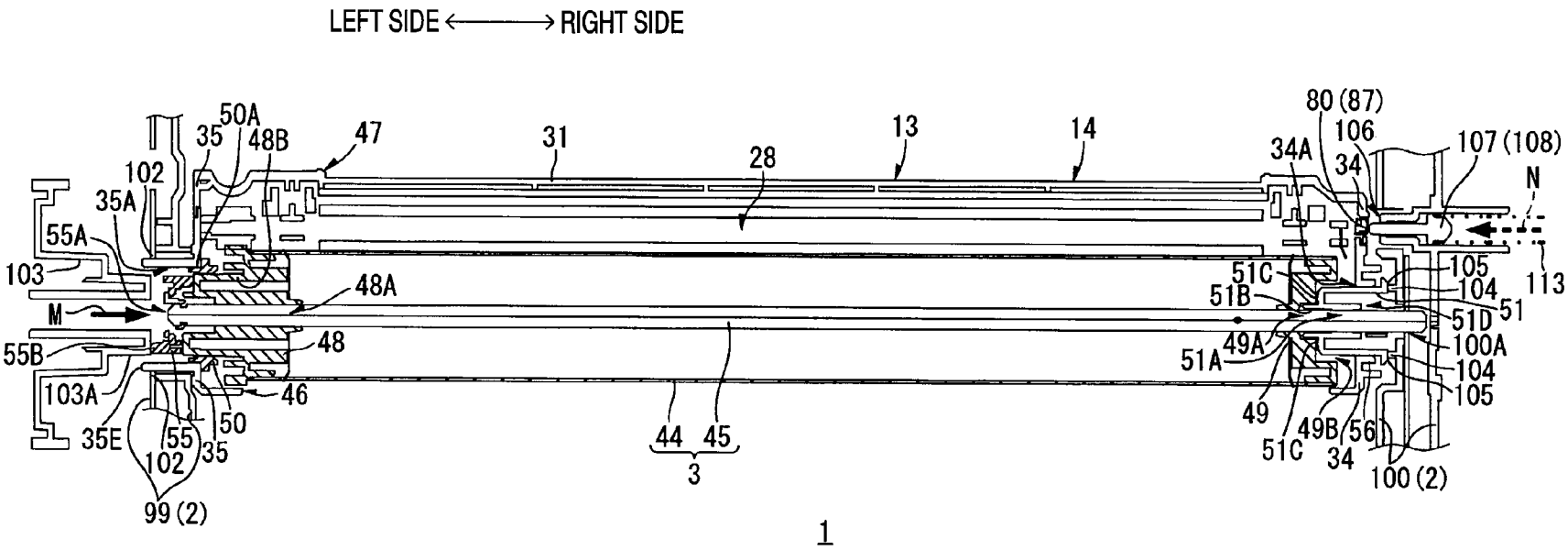
FIG. 19 is a step sectional view of the image forming apparatus taken along the line XIX-XIX of FIG. 17.

The body casing 2 of the image forming apparatus includes a driving force transmitting portion 103 for transmitting the driving force (see FIG. 19). The driving force transmitting portion 103 is engaged with the driving force receiving portion 55, which is exposed on the left side of the first casing 46, through the protrusions 55B. Accordingly, the driving force receiving portion 55 receives the driving force from the driving force transmitting portion 103 and rotates, such that the photosensitive drum 3 (the drum body 44), which is made as a single body with the driving force receiving portion 55, is rotated. The driving force transmitting portion 103 will be further described below.

(4) Right Bearing

The right bearing 51 substantially has a hollow cylindrical shape and a center axis of the right bearing 51 extends along the widthwise direction. A hollow portion of the right bearing 51 forms a circular hole that passes through a circular center portion of the right bearing 51 along the widthwise direction. The hollow portion of the right bearing 51 forms a bearing through hole 51A. The bearing through hole 51A substantially has the same diameter as the right through hole 49A. A left end portion of the right bearing 51 has a smaller diameter than a portion on the right side with respect to the left end portion. The left end portion of the right bearing 51 forms a small diameter portion 51B. In the right bearing 51, a surface is formed to extend in the radial direction from a right end of the small diameter portion 51B, and at this surface, a convex portion 51C is formed to slightly protrude to the left side. The convex portion 51C has a ring-like shape that surrounds the small diameter portion 51B in left side view. At a right end surface of the right bearing 51, a concave portion 51D is formed to be depressed leftward. As shown in FIGS. 7A and 7B, the concave portion 51D has a cylindrical shape that is concentric with the bearing through hole 51A. In the concave portion 51D, a plurality of first ribs 52 and a plurality of second ribs 53 are provided. For example, in this exemplary embodiment, two first rib 52 and two second ribs 53 are provided. The first ribs 52 and the second ribs 53 are provided as a single body with the right bearing 51.

As shown in FIG. 7A, the first ribs 52 have plate-like shapes that are opposed to each other with the bearing through hole 51A interposed therebetween in right side view. The second ribs 53 are disposed to be shifted by approximately 90° with respect to the first ribs 52 around the bearing through hole 51A in right side view. The second ribs 53 are opposed to each other with the bearing through hole 51A interposed therebetween in right side view, and are swollen in a substantially trapezoidal shape toward the bearing through hole 51A. In the second ribs 53, opposing portions are flat surfaces which are in parallel with each other.

A depression 51E is formed in a portion corresponding to one second rib 53A at an outer peripheral surface of the right bearing 51. In the depression 51E, a hook 58 is provided. The hook 58 is bent to the outside in the radial direction while continuously extending to the right side from the left end portion of the right bearing 51 (see FIG. 7B).

In connection with the right bearing 51, as shown in FIG. 6, a circular through hole is formed in a portion opposed to the photosensitive drum 3 in the widthwise direction at a right sidewall (i.e., the fifth process wall 34) of the first casing 46 of the process casing 14. The through hole forms a right exposure hole 34A. The right exposure hole 34A is a circular hole that has a diameter larger than the outer diameter of the right bearing 51. The right bearing 51 is loosely fitted into the right exposure hole 34A. In this state, a right end portion of the right bearing 51 is exposed on the right side of the first casing 46 through the right exposure hole 34A. Specifically, the right end surface of the right bearing 51 is located on the right side with respect to the fifth process wall 34.

At a right surface of the fifth process wall 34, a positioning rib 56 is provided at the edge of the right exposure hole 34A to extend toward the inside of the right exposure hole 34A (i.e., the inward side in the radial direction). When the positioning rib 56 is in contact with the outer peripheral surface of the right bearing 51, the right bearing 51 is positioned in the right exposure hole 34A in the radial direction such that the bearing through hole 51A of the right bearing 51 is substantially concentric with the inner peripheral surface of the left bearing 50. In this state, movement of the right bearing 51 in the widthwise direction with respect to the first casing 46 is permitted. At this time, since the hook 58 (see FIG. 7B) of the right bearing 51 is engaged with a groove (not shown) provided in the first casing 46, the right bearing 51 remains positioned in the first casing 46.

A portion in the drum shaft 45 located on the right side with respect to the right through hole 49A of the right flange 49 is inserted into the bearing through hole 51A of the right bearing 51. In this state, a left portion of the right bearing 51 is loosely fitted into the first concave portion 49B of the right flange 49, and the small diameter portion 51B which is the left end portion of the right bearing 51 is loosely fitted into the second concave portion 49C of the right flange 49. Then, the convex portion 51C of the right bearing 51 is in contact with a portion corresponding to the innermost portion (i.e., a left end portion) of the first concave portion 49B at the right end surface of the right flange 49 from the right side. Accordingly, the right flange 49, that is, the right end portion of the photosensitive drum 3 is rotatably supported by the right bearing 51. When the photosensitive drum 3 rotates, the right end surface of the right flange 49 comes into slide contact with the convex portion 51C of the right bearing 51.

The photosensitive drum 3 is supported by the process casing 14 (first casing 46) through the left bearing 50 and the right bearing 51 attached to the first casing 46. As described above, in the photosensitive drum 3, the movement of the left flange 48 in the widthwise direction with respect to the left bearing 50 is permitted, and the movement of the right bearing 51 in the widthwise direction with respect to the first casing 46 is permitted. That is, in a state in which the process casing 14 is disposed, the photosensitive drum 3 is relatively movable in the widthwise direction with respect to the first casing 46 of the process casing 14. In other words, the photosensitive drum 3 and the process casing 14 are moved separately and relatively movable.

A right end of the drum shaft 45 is located on the right side with respect to the right bearing 51, and the cutout 45A (see FIG. 7B) of the drum shaft 45 is located in the concave portion 51D of the right bearing 51. As shown in FIGS. 7A and 7B, a fastener 54 is attached to the cutout 45A of the drum shaft 45.

(5) Fastener

The fastener 54 is made of resin or the like. The fastener 54 substantially has a C shape in right side view, and is engaged with the drum shaft 45 at the cutout 45A to fasten the drum shaft 45 (see FIG. 7A). In a portion of the fastener 54 opposed to the flat surface 45B of the drum shaft 45, a flat surface 54A is formed (see FIG. 7B). Then, if the flat surface 54A of the fastener 54 is in contact with the flat surface 45B of the drum shaft 45, relative rotation of the fastener 54 with respect to the drum shaft 45 is restricted. In addition, the fastener 54 is disposed in the cutout 45A in the widthwise direction. Thus, relative movement of the fastener 54 in the widthwise direction with respect to the drum shaft 45 is restricted. In a portion on a rear side of the flat surface 54A at an outer peripheral surface of the fastener 54, a flat surface 54B is formed (see FIG. 7B). The flat surface 54A and the flat surface 54B are substantially in parallel with each other.

In this state, as shown in FIG. 7A, the fastener 54 is sandwiched between the first ribs 52 of the right bearing 51. In addition, the drum shaft 45 is sandwiched between the second ribs 53. Specifically, one second rib 53A is in contact with the fastener 54 and portions on the left and right side of the fastener 54 at the outer peripheral surface of the drum shaft 45. Accordingly, the fastener 54 is prevented from being unfastened from the drum shaft 45. The other second rib 53B is in contact with a portion of the cutout 45A unfastened by the fastener 54 at the outer peripheral surface of the drum shaft 45. As such, the second ribs 53 sandwich the drum shaft 45 and the fastener 54 attached to the cutout 45A of the drum shaft 45 together. In addition, the front end of one second rib 53A (i.e., a portion opposed to the other second rib 53B) has a flat surface, as described above, and is in contact with the flat surface 54B of the fastener 54. For this reason, relative rotation of the right bearing 51 with respect to the fastener 54 is restricted.

As such, in the state shown in FIG. 6, the drum shaft 45, the right bearing 51, and the fastener 54 are made as a single body. For this reason, relative rotation of the right bearing 51 with respect to the drum shaft 45 (in other words, relative rotation of the drum shaft 45 with respect to the right bearing 51) is restricted. Moreover, if the drum shaft 45 is pressed into the bearing through hole 51A of the right bearing 51, relative rotation of the right bearing 51 with respect to the drum shaft 45 is restricted.

The right end of the drum shaft 45 is exposed on the right side of the first casing 46 through the right exposure hole 34A of the fifth process wall 34 (see FIG. 3).

(6) Second Casing

In connection with the left bearing 50 and the right bearing 51 (see FIG. 6), in the second casing 47 of the process casing 14, a left contact portion 47A as an example of a second regulating portion is provided at a position corresponding to the left bearing 50 (specifically, a portion on the right side with respect to the left end portion 50A) in the widthwise direction. In addition, a right contact portion 47B is provided at a position corresponding to the right bearing 51 (specifically, a portion on the right side with respect to the small diameter portion 51B) in the widthwise direction. The left contact portion 47A and the right contact portion 47B are disposed on the inward side of the fifth process wall 34 and the sixth process wall 35 in the widthwise direction, and extend downward from the second process wall 31. The left contact portion 47A is in contact with the left bearing 50 from the above, and the right contact portion 47B is in contact with the right bearing 51 from the above. That is, the second casing 47 is in contact with the left bearing 50 and the right bearing 51 at the left contact portion 47A and the right contact portion 47B.

In this state, as shown in FIG. 9B, the third convex portion 50D of the left bearing 50 attached to the first casing 46 is engaged with the first casing 46 at the left rib 35B, as described above. The left contact portion 47A (see a dotted-line portion in the drawing) is in contact with a portion on an upper back side with respect to the first convex portion 50B and the second convex portion 50C at the outer peripheral surface of the left bearing 50. As such, a portion in contact with the left contact portion 47A at the outer peripheral surface of the left bearing 50 is referred to as a contacted portion 50F.

Since the left contact portion 47A is in contact with the contacted portion 50F of the left bearing 50, movement of the left bearing 50 is regulated. Of course, rotation of the left bearing 50 in a direction opposite to the first direction A is also regulated. In this state, a portion (referred to as a sidewall 47C: see FIG. 3) forming the sixth process wall 35 in the second casing 47 is located on an upstream side in the first direction with respect to the first convex portion 50B and the second convex portion 50C. For this reason, even though the left bearing 50 rotates in the direction opposite to the first direction, the sidewall 47C (see FIG. 3) is in contact with the first convex portion 50B and the second convex portion 50C until the third convex portion 50D and the left rib 35B are disengaged from each other, and the rotation of the left bearing 50 is stopped. Accordingly, the left bearing 50 is prevented from being separated from the first casing 46 when the third convex portion 50D and the left rib 35B are disengaged from each other.

(7) Charger

As shown in FIG. 2B, the charger 4 is supported by the second process wall 31 (i.e., part of the second casing 47) in the first space 28 above the photosensitive drum 3. The charger 4 is disposed to be opposed to the photosensitive drum 3 at an interval so as not to come into contact with the photosensitive drum 3. Specifically, the charger 4 includes a discharge wire 60 that is disposed to be opposed to the photosensitive drum 3 at an interval, and a grid 61 that is provided between the discharge wire 60 and the photosensitive drum 3, and controls the amount of electric charges from the discharge wire 60 to the photosensitive drum 3. If a bias is applied to the grid 61 and a high voltage is applied to the discharge wire 60, the discharge wire 60 generates corona discharge, such that the surface of the photosensitive drum 3 (drum body 44) is uniformly charged. The charger 4 also includes a wire cleaner (not shown) in which the discharge wire 60 is provided. The wire cleaner slides in the widthwise direction to clean the discharge wire 60. The charger 4 (particularly, the discharge wire 60) is exposed upward through the fifth opening 42 of the second process wall 31.

(8) Cleaning Member

Figure 11:
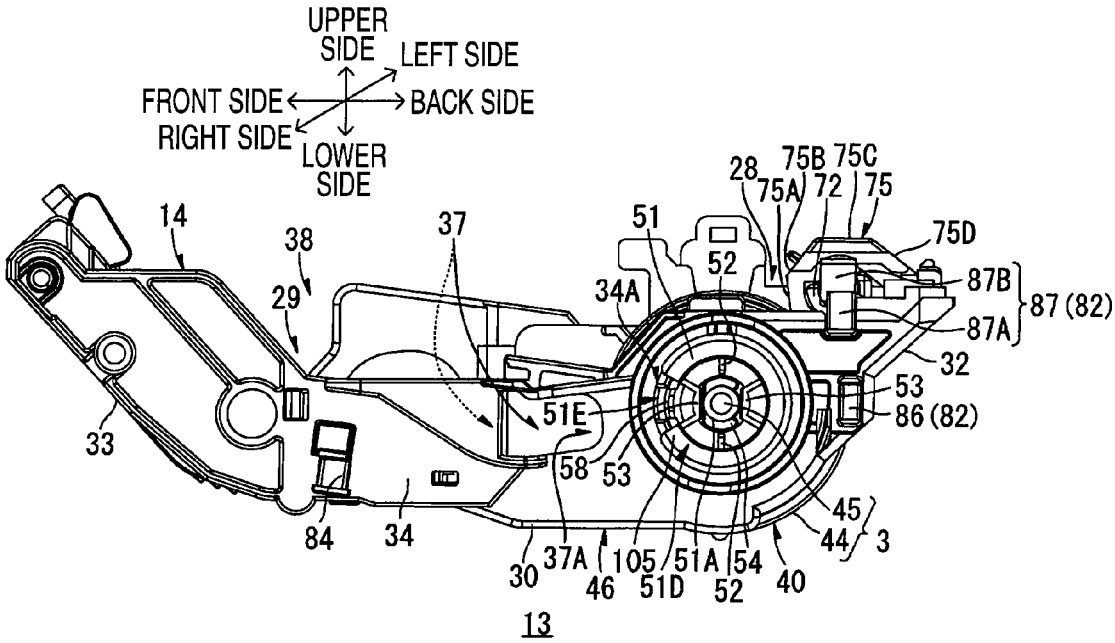
FIG. 11 is a right side view of a process cartridge having mounted thereon the cover of FIG. 10.
Figure 12:
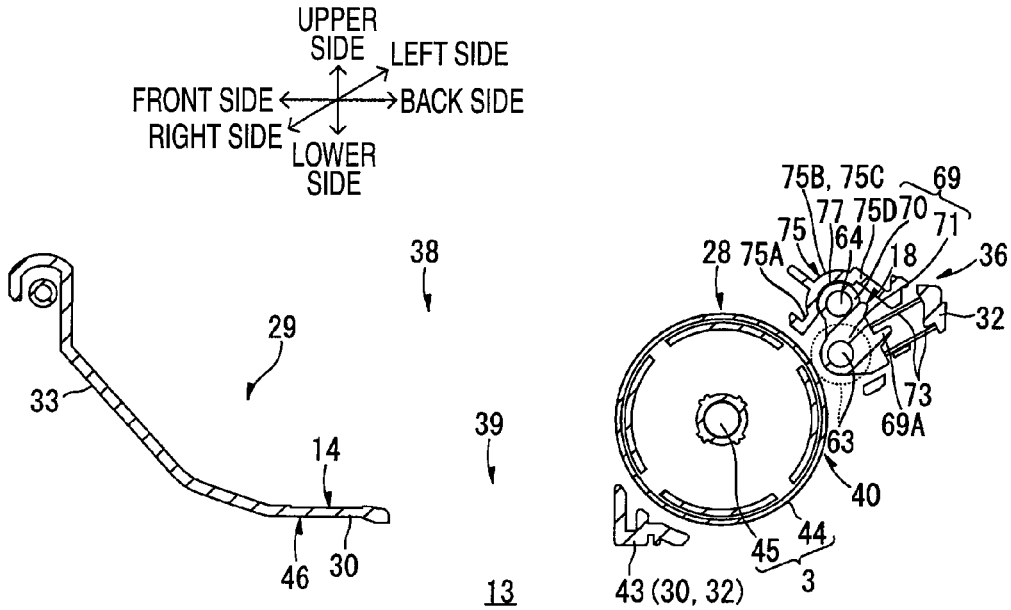
FIG. 12 is a sectional view taken along the line XII-XII of FIG. 10.
Figure 13:
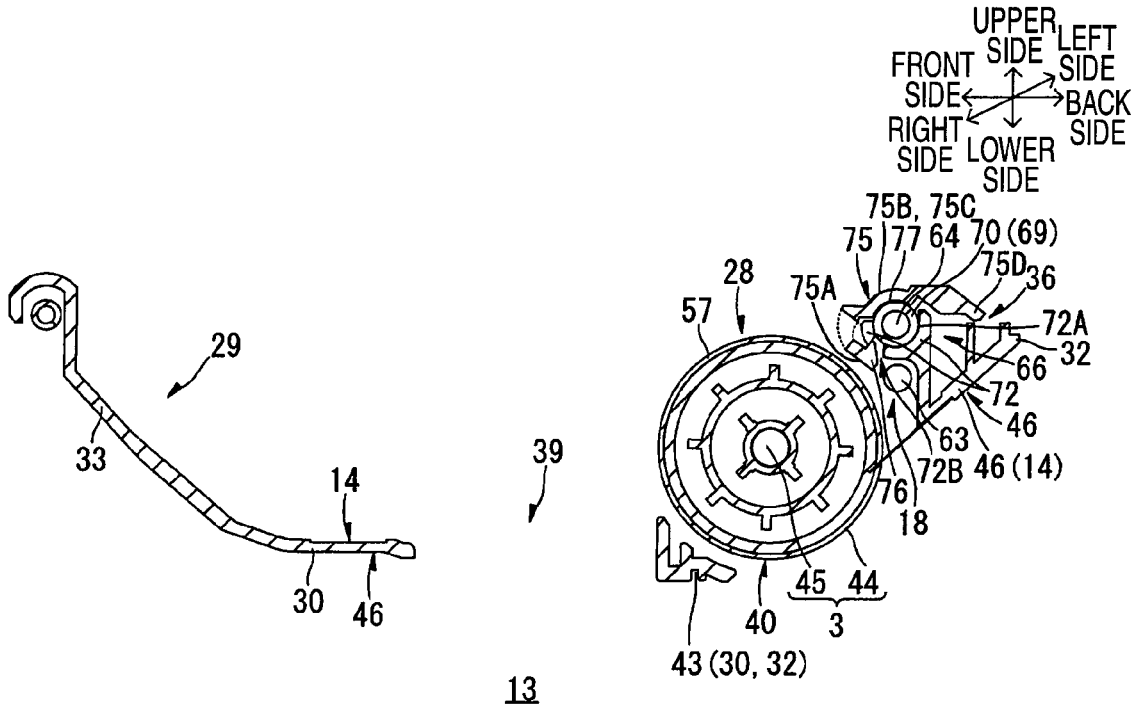
FIG. 13 is a sectional view taken along the line XIII-XIII of FIG. 10.
Figure 14:
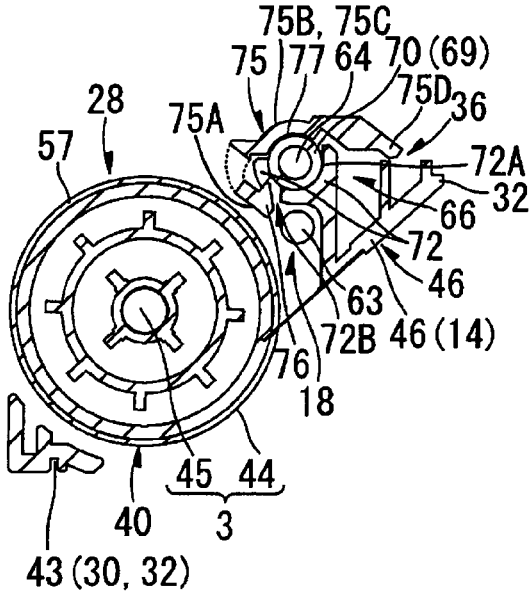
FIG. 14 is an enlarged view of a rear portion of FIG. 13.
Figure 15:
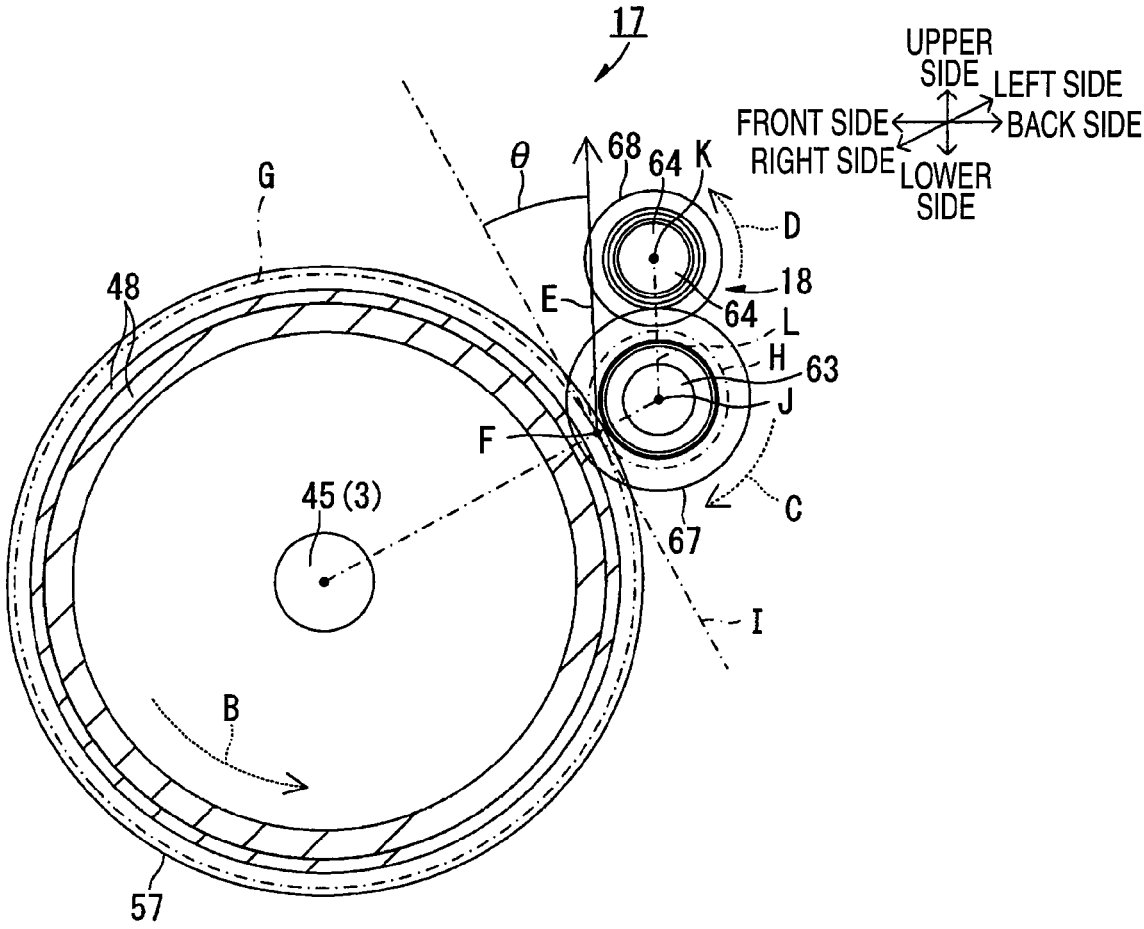
FIG. 15 is a right side section view of the periphery of a first gear, a second gear, and a third gear of the process cartridge of FIG. 13.

FIG. 10 is a diagram of the process cartridge having mounted thereon a cover as viewed from an upper front side. FIG. 11 is a right side view of a process cartridge having mounted thereon the cover. FIG. 12 is a sectional view taken along the line XII-XII of FIG. 10. FIG. 13 is a sectional view taken along the line XIII-XIII of FIG. 10. FIG. 14 is an enlarged view of a rear portion of FIG. 13. FIG. 15 is a right side sectional view of the periphery of a first gear, a second gear, and a third gear.

The cleaning member 18 is disposed on the back side with respect to the photosensitive drum 3 in the first space 28, and is supported by the first casing 46 (see FIG. 5). The cleaning member 18 includes a cleaning roller 63 and a cleaning shaft 64 together as an example of a paper dust collecting member, a film 65, and a paper dust container 66.

An outer peripheral surface of the cleaning roller 63 is formed of sponge. The center axis of the cleaning roller 63 extends along the widthwise direction. As shown in FIG. 5, a second gear 67 is provided at a left end portion of the cleaning roller 63. The second gear 67 has a hollow cylindrical shape whose center axis extends along the widthwise direction. In the second gear 67, a left portion 67A has a larger diameter than a right portion 67B. In the second gear 67, gear teeth are formed on an outer peripheral surface of each of the left portion 67A and the right portion 67B. The second gear 67 is externally engaged with the left end portion of the cleaning roller 63 (specifically, a shaft of the cleaning roller 63). In this state, the second gear 67 is concentric with the cleaning roller 63.

The cleaning shaft 64 has an elongated metal cylindrical shape in the widthwise direction, and a center axis of the cleaning shaft 64 extends along the widthwise direction. At a left end portion of the cleaning shaft 64, a third gear 68 is provided. The third gear 68 has a hollow cylindrical shape whose center axis extends along the widthwise direction. At an outer peripheral surface of the third gear 68, gear teeth are formed. The third gear 68 is externally engaged with the left end portion of the cleaning shaft 64. In this state, the third gear 68 is concentric with the cleaning shaft 64.

The cleaning member 18 includes a plurality of bearing members 69 for supporting the cleaning roller 63 and the cleaning shaft 64. In this exemplary embodiment, two bearing members 69 are provided, one on each end of the cleaning member 18 in a widthwise direction. Each of the bearing members 69 includes a first bearing 70 and a second bearing 71. The first bearing 70 and the second bearing 71 have hollow cylindrical shapes whose center axes extend along the widthwise direction. The first bearing 70 is longer than the second bearing 71 in the widthwise direction. The first bearing 70 and the second bearing 71 are connected with each other and are made as a single body (see FIG. 12). In other words, the first bearing 70 includes the second bearing 71.

As described above, one of the bearing members 69 is provided at the left end portions of the cleaning roller 63 and the cleaning shaft 64, and the other is provided in the right end portions of the cleaning roller 63 and the cleaning shaft 64. In the bearing member 69 provided on the left side, the left end portion of the cleaning shaft 64 (specifically, a portion on the right side with respect to the third gear 68) is inserted into a hollow portion of the first bearing 70. The left end portion of the cleaning roller 63 (specifically, a portion on the right side with respect to the second gear 67) is inserted into a hollow portion of the second bearing 71. In the bearing member 69 provided on the right side, the right end portion of the cleaning shaft 64 is inserted into a hollow portion of the first bearing 70, and the right end portion of the cleaning roller 63 is inserted into a hollow portion of the second bearing 71. The cleaning roller 63 is rotatably supported by the left and right second bearings 71. And, the cleaning shaft 64 is rotatably supported by the left and right first bearings 70. That is, the cleaning roller 63 and the cleaning shaft 64 are rotating bodies. In this state, the outer peripheral surface of the cleaning shaft 64 is in contact with the outer peripheral surface of the cleaning roller 63 from the above (see FIG. 2B).

Along with the bearing members 69, arm portions 72 are provided at both ends in the back end portion of the first casing 46 along the widthwise direction to extend upward in the first space 28 (see FIG. 13). At an upper surface in a distal end portion (upper end portion) of each arm portion 72, a depression 72A having a substantially U shape-like is formed, and at a side surface on a lower front side in the distal end portion of the arm portion 72, a recess 72B as an example of an engagement portion is provided (see FIG. 13). The first bearing 70 of the left bearing member 69 (specifically, a portion outside the second bearing 71 in the widthwise direction) is fitted into the depression 72A of the left arm portion 72 from the above, and the first bearing 70 of the right bearing member 69 (specifically, a portion outside the second bearing 71 in the widthwise direction) is fitted into the depression 72A of the right arm portion 72 from the above. In the first casing 46, a support portion 74 having a shape similar to the arm portion 72 is provided at a position inside the arm portion 72 in the widthwise direction at an internal (see FIGS. 8B and 9B). The first bearing 70 of each bearing member 69 (specifically, a portion inside the second bearing 71 in the widthwise direction) is placed in an upper end portion of the support portion 74 (see FIGS. 8A and 9A).

Each first bearing 70 is supported by the corresponding arm portion 72, and freely slides on the circumferential surface in the depression 72A of the arm portion 72. Accordingly, each bearing member 69 freely rotates with the first bearing 70 as an axis. Specifically, in each bearing member 69, the second bearing 71, which is spaced apart from the first bearing 70, and the cleaning roller 63, which is supported by the second bearing 71, freely rotate around the first bearing 70. The swing center (swing center K described below) of the second bearing 71 swinging around the first bearing 70 and the center axis (rotation center) of the cleaning shaft 64 rotatably supported by the first bearing 70 are coincident with each other.

In this state, the first gear 57 of the photosensitive drum 3 is meshed with the right portion 67B of the second gear 67 of the cleaning roller 63, and the left portion 67A of the second gear 67 is meshed with the third gear 68 of the cleaning shaft 64. As shown in FIG. 15, the photosensitive drum 3 rotates in a counterclockwise direction (see a dotted-line arrow B in the drawing) in right side view. Accordingly, the second gear 67 which is meshed with the first gear 57 of the photosensitive drum 3 rotates in a clockwise direction (see a dotted-line arrow C in the drawing) in right side view, if the driving force is transmitted from the first gear 57 (i.e., the driving force is received by the driving force receiving portion 55 of the photosensitive drum 3). The second gear 67 rotates the cleaning roller 63 by the transmitted driving force. Then, the third gear 68 which is meshed with the second gear 67 is rotated in a counterclockwise direction (see a dotted-line arrow D in the drawing) in right side view by the driving force transmitted from the second gear 67. The third gear 68 rotates the cleaning shaft 64 by the transmitted driving force.

An application direction of a pressing force of the tooth surface of the first gear 57 against the tooth surface of the second gear 67 is represented by E (see a solid-line arrow in the drawing). The application direction E extends from a contact position F between the tooth surface of the first gear 57 and the tooth surface of the second gear 67. A circle that passes through the contact position F and is concentric with the first gear 57 is referred to as a reference circle G. In addition, a circle that passes through the contact position F and is concentric with the second gear 67 is referred to as a reference circle H. An angle between a common tangential line I (passing through the contact position F) for the reference circles G and H, and the application direction E (extending from the contact position F) is a pressure angle θ in the first gear 57 and the second gear 67. The pressure angle θ is, for example, approximately 20°. The rotation center of the cleaning shaft 64 and the third gear 68 (also referred to as the swing center K of the second bearing 71) is positioned on a downstream side of the rotation center J of the second gear 67 and the cleaning roller 63 in a direction parallel to the application direction E (i.e., a pressure angle application direction or a direction in which an application line of the pressure angle extends). In other words, a line L connecting the rotation center J of the cleaning roller 63 and the swing center K of the second bearing 71 is in parallel with the pressure angle application direction E.

As shown in FIG. 12, in a portion corresponding to the second bearing 71 of each bearing member 69 opposed to the third process wall 32 of the first casing 46, a convex portion 69A is provided as a single body. A spring 73, as an example of a pressing member, is interposed between each bearing member 69 and the third process wall 32. Specifically, the spring 73 is disposed in a portion of the first space 28 corresponding to the connection portion 36 (i.e., a back end portion in the process casing 14) (see FIG. 2B). The spring 73 is, for example, a coil spring, and an end portion of the spring 73 on the bearing member 69 side is fitted into the convex portion 69A. Each bearing member 69 is pressed by an expansion force of the spring 73 such that the second bearing 71 swings in a direction coming close to the photosensitive drum 3. Accordingly, in the cleaning roller 63 supported by the second bearing 71 of each bearing member 69, the outer peripheral surface is pressed into contact with the outer peripheral surface of the photosensitive drum 3 (specifically, the drum body 44) from the back side. That is, the spring 73 presses the cleaning roller 63 against the photosensitive drum 3, and the second bearing 71 swings such that the cleaning roller 63 is pressed against the photosensitive drum 3.

As shown in FIG. 2B, the film 65 extends upward from the third process wall 32 upward, and is in contact with the back-side outer peripheral surface of the cleaning shaft 64 from the back side. The film 65 blocks a gap between the third process wall 32 and the cleaning shaft 64, and accordingly leakage of paper dust from the paper dust container 66 is suppressed. Moreover, it is advantageous to extend the film 65 from the back end of the first process wall 30 in accordance with rotation direction of the cleaning shaft 64. That is, it is advantageous to bring the film 65 into contact with the cleaning shaft 64 so as not to disturb the rotation of the cleaning shaft 64.

The borders of the paper dust container 66 are formed by the cleaning shaft 64, the film 65, the second process wall 31, the third process wall 32, the fifth process wall 34, and the sixth process wall 35, and the paper dust container 66 is thus a space having a substantially triangular shape that is tapered toward the back side in right side sectional view. The paper dust container 66 is provided in a portion of the first space 28 corresponding to the connection portion 36.

In the cleaning member 18, at a time of image formation, a bias supply source (not shown) which is provided in the body casing 2 applies a primary cleaning bias to the cleaning roller 63. In addition, a bias supply source (not shown) applies a secondary cleaning bias to the cleaning shaft 64.

While the developer image is being transferred from the photosensitive drum 3 to the sheet P, paper dust may be stuck to the photosensitive drum 3 from the sheet P. In addition, after the developer image is transferred to the sheet P, untransferred developer may remain on the photosensitive drum 3. Of the foreign substances on the photosensitive drum 3, such as paper dust or untransferred developer, untransferred developer is transferred to the surface of the cleaning roller 63 by the primary cleaning bias, and caught by the cleaning roller 63. In addition, of the foreign substances on the photosensitive drum 3, paper duet is first transferred to the cleaning roller 63 by the primary cleaning bias at a time other than at the time of image formation, then transferred to the surface of the cleaning shaft 64 by the secondary cleaning bias (specifically, a bias which is different than the primary cleaning bias such that there is a difference in bias between the primary cleaning bias and the secondary cleaning bias), and subsequently collected by the cleaning shaft 64. That is, the cleaning shaft 64 selectively collects paper dust from among the foreign substances caught by the cleaning roller 63. The paper dust collected by the cleaning shaft 64 is wiped by a wiping member 78 described further below and stored in the paper dust container 66.

At the end of image formation, a bias opposite to the primary cleaning bias is applied to the cleaning roller 63. Then, untransferred developer caught by the cleaning roller 63 is discharged from the cleaning roller 63 to the photosensitive drum 3, and collected by the developing roller 6.

In connection with the cleaning member 18, the process cartridge 13 includes a cover 75.

(9) Cover

The cover 75 substantially has a longitudinal rectangular plate-like shape in the widthwise direction in plan view, and has a sufficient size to block the fourth opening 41 of the process casing 14 from the inside (lower side) of the process casing 14 (see FIG. 3). The cover 75 is disposed in the first space 28 to be opposed to the cleaning member 18 (specifically, the cleaning shaft 64) from the above, and is exposed on the upper side through the fourth opening 41.

As shown in FIGS. 11 and 12, the cover 75 includes, as a single body, a first portion 75A, a second portion 75B, a third portion 75C, and a fourth portion 75D.

The first portion 75A is bent in a substantially U-like shape, and is disposed between the photosensitive drum 3 and the cleaning shaft 64.

The second portion 75B is connected to an upper end portion of the first portion 75A, and extends upward to a front edge of the fourth opening 41. The second portion 75B is disposed between the charger 4 and the cleaning shaft 64. In the second portion 75B, a surface opposed to the cleaning shaft 64 is formed of sponge, and at this surface, a wiping member 78 is provided to be in contact with the cleaning shaft 64. The wiping member 78 blocks a gap between the second portion 75B and the cleaning shaft 64. Therefore, leakage of paper dust stored in the paper dust container 66 from the gap between the second portion 75B and the cleaning shaft 64 is suppressed.

The third portion 75C is connected to an upper end portion of the second portion 75B and extends to the back side. The third portion 75C is disposed between the fourth opening 41 and the cleaning shaft 64. Since the third portion 75C extends to the back side, it is in parallel with the second process wall 31, which extends along the front-back direction. Specifically, the outer surface of the third portion 75C (an upper surface exposed on the upper side in the fourth opening 41) is flush with a periphery 31A (see a dotted-line portion in the drawing) of the fourth opening 41 at the outer surface (upper surface) of the second process wall 31.

The fourth portion 75D is connected to a back end portion of the third portion 75C, and extends to the obliquely lower back side in the first space 28 so as to block a back-side edge of the fourth opening 41 from the inside (lower side) of the process casing 14. A lower end portion of the fourth portion 75D is in contact with the third process wall 32 of the first casing 46, and the cover 75 is positioned in the process casing 14.

As shown in FIGS. 13 and 14, with reference to a right sectional view of the cover 75 in the widthwise direction different from FIG. 2B, in portions corresponding to the first portion 75A at both end portions of the cover 75 in the widthwise direction, hooks 76 as an example of an engaging portion are provided as a single body to protrude toward the obliquely upper back side. In addition, at lower surfaces of portions corresponding to the second portion 75B and the third portion 75C at both end portions of the cover 75 in the widthwise direction, cover depressions 77 are formed to be depressed in a curved shaped upward. The hook 76 and the corresponding cover depression 77 are located at the same position in the widthwise direction.

In the first bearing 70 of the bearing member 69 fitted into the depression 72A of the arm portion 72 in the first casing 46 from the above, an upper portion is fitted into the corresponding to cover depression 77, and the first bearing 70 is fixed by being sandwiched between the cover 75 and the process casing 14 (the arm portion 72 of the first casing 46). In this state, the hooks 76 of the cover 75 are correspondingly engaged with the recesses 72B of the arm portions 72. Accordingly, the first bearing 70 is kept to be sandwiched between the cover 75 and the process casing 14.

As described above with reference to FIG. 2B, the cover 75 is disposed to be opposed to the cleaning member 18 from the above, and blocks the fourth opening 41 from the inside (lower side). For this reason, even though the foreign substances caught by the cleaning member 18 (particularly, paper dust collected by the cleaning shaft 64) fly off the cleaning member 18, the flying foreign substances are received on a surface of the cover 75 opposed to the cleaning member 18. As such, if the cover 75 is provided separately from the process casing 14, the amount of flying paper dust when the process casing 14 is disassembled in order to discard paper dust stored in the paper dust container 66 can be reduced, as compared with a case in which the cover 75 and the process casing 14 are formed as a single body.

(10) Electrode

As shown in FIG. 2A, the process cartridge 13 is provided with, as electrodes to which bias is applied from the body casing 2, a first electrode 81, a second electrode 82, a third electrode 83, and a fourth electrode 84.

The first electrode 81 includes a grid electrode 88 and a wire electrode 89. The first electrode 81 supplies a bias from the body casing 2 to the charger 4.

The grid electrode 88 is provided near the charger 4 (see FIG. 2B) at the right surface of the fifth process wall 34 in the second casing 47 as viewed from the widthwise direction, and is electrically connected to the grid 61. The grid electrode 88 supplies a bias from the body casing 2 to the grid 61.

The wire electrode 89 is provided in the front end portion at the right surface of the fifth process wall 34 in the second casing 47, and is electrically connected to the discharge wire 60. The wire electrode 89 supplies a bias (the high voltage) from the body casing 2 to the discharge wire 60.

The second electrode 82 includes a cleaning roller electrode 86 and a cleaning shaft electrode 87 as an example of an electrode. The second electrode 82 supplies a bias from the body casing 2 to the cleaning member 18.

The cleaning roller electrode 86 is provided near the cleaning roller 63 (see FIG. 2B) at the right surface of the fifth process wall 34 in the first casing 46 as viewed from the widthwise direction, and is electrically connected to the cleaning roller 63. The cleaning roller electrode 86 supplies a bias from the body casing 2 (the primary cleaning bias) to the cleaning roller 63.

The cleaning shaft electrode 87 is provided near the cleaning shaft 64 (see FIG. 2B) at the right surface of the fifth process wall 34 in the first casing 46 as viewed from the widthwise direction, and is electrically connected to the cleaning shaft 64. The cleaning shaft electrode 87 supplies a bias from the body casing 2 (the secondary cleaning bias) to the cleaning shaft 64.

Specifically, as shown in FIG. 5, the cleaning shaft electrode 87 is attached to the first casing 46 so as to protrude upward from an upper end of the first casing 46. The cleaning shaft electrode 87 includes, as a single body, an exposed portion 87A and a bent portion 87B. The exposed portion 87A is exposed at the right surface of the fifth process wall 34, and extends upward. The exposed portion 87A of the cleaning shaft electrode 87 is sandwiched between the first casing 46 and the second casing 47, such that the cleaning shaft electrode 87 is positioned in the process casing 14 (see FIG. 2A). The bent portion 87B is connected to the exposed portion 87A, extends upward, and is bent to a lower left side (also see FIG. 11). The bent portion 87B formed in such a manner has elasticity. In the bent portion 87B, a portion bent to the lower left side is pressed into contact with the right end surface of the cleaning shaft 64 from the right side by elasticity of the bent portion 87B.

The third electrode 83 is provided at a right surface of a right sidewall in a developing casing 90 (described below) of the developing cartridge 17 (see FIG. 16). The third electrode 83 supplies a bias from the body casing 2 to the developing cartridge 17 (for example, to the developing roller 6).

As shown in FIG. 2A, the fourth electrode 84 is provided near the third electrode 83 (see a dotted-line portion in the drawing) at the right surface of the fifth process wall 34 in the first casing 46 as viewed from the widthwise direction. In a state in which the developing cartridge 17 is mounted in the process casing 14, though not shown, the fourth electrode 84 comes in contact with the third electrode 83, and is electrically connected to the third electrode 83.

The first electrode 81, the second electrode 82, and the fourth electrode 84 may be collectively referred to as a cartridge electrode 80.

(Developing Cartridge)

Figure 16:
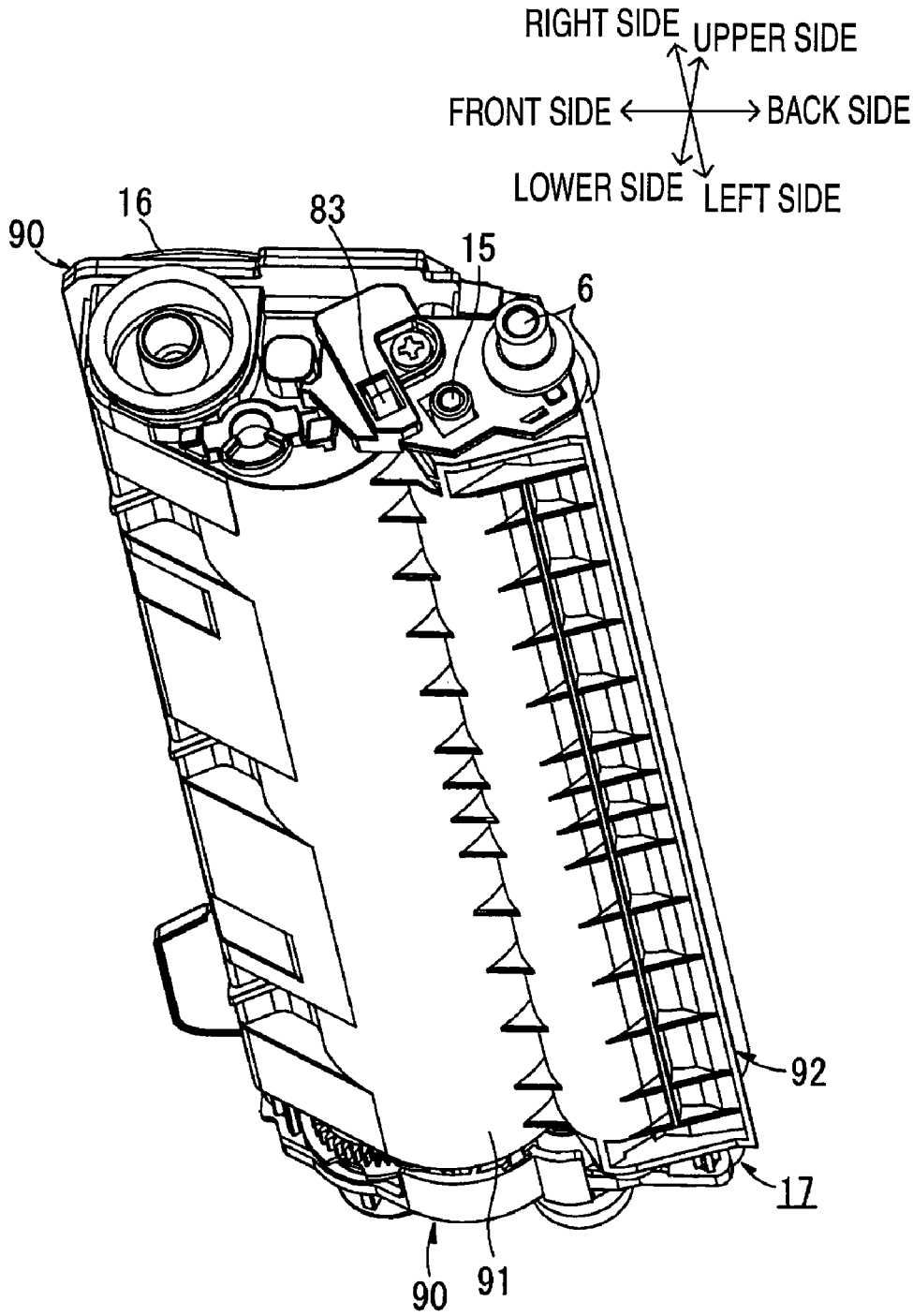
FIG. 16 is a perspective view of a developing cartridge of the process cartridge of FIG. 3 as viewed from a lower right side.

FIG. 16 is a perspective view of a developing cartridge as viewed from a lower right side.

As shown in FIG. 2B, the developing cartridge 17 includes a developing casing 90. The developing casing 90 has a longitudinal box shape in the widthwise direction (see FIG. 16), and has a size to an extent so as to be fit in the second space 29 of the process casing 14.

In a state in which the process cartridge 13 is mounted in the body casing 2, and the developing cartridge 17 is mounted in the process casing 14, the developing casing 90 is inclined toward the obliquely upper front side (see FIG. 1) in a similar manner as the process casing 14 is inclined. In the following description, unless it is particularly described, as shown in FIGS. 2A, 2B, and 15, the developing cartridge 17 will be described based on a state in which the developing cartridge 17 is separated from the body casing 2 and placed on a horizontal surface (a surface along the front-back direction).

As shown in FIG. 2B, in the developing casing 90, a sidewall (a lower wall) which is opposed to the first process wall 30 of the process casing 14 is referred to as a developing sidewall 91. An opening 92 is formed at a back end of the developing casing 90. The opening 92 communicates with the inside of the developing casing 90.

In the midstream of the developing casing 90 along the front-back direction, a partition wall 93 is provided to extend in the widthwise direction. The partition wall 93 partitions the developing casing 90 into a first region 94 and a second region 95. The first region 94 is located on the front side with respect to the second region 95. A communicating hole 96 is formed in the partition wall 93, and the first region 94 and the second region 95 communicate with each other through the communicating hole 96.

The first region 94 corresponds to the inside of the toner hopper 16, and accommodates the developer. In the first region 94, an agitator 97 is rotatably disposed. If the agitator 97 rotates, the developer in the first region 94 is stirred by the agitator 97, and is discharged to the second region 95 through the communicating hole 96. The first region 94 substantially has a circular shape as viewed from the widthwise direction in order to allow the agitator 97 to rotate.

The second region 95 houses the developing roller 6 and the supply roller 15. The supply roller 15 is disposed on the back side with respect to the communicating hole 96 to be close to the communicating hole 96. The developing roller 6 is disposed on the back side (specifically, the obliquely upper back side) with respect to the supply roller 15. In the developing roller 6, the outer peripheral surface on the front side is pressed into contact with the outer peripheral surface of the supply roller 15, and a nip is formed between the developing roller 6 and the supply roller 15. In the developing roller 6, the outer peripheral surface on the upper back side is exposed through the opening 92 of the developing casing 90. At the right sidewall of the developing casing 90, the right end portions of the developing roller 6 (specifically, the shaft of the developing roller 6) and the supply roller 15 (specifically, the shaft of the supply roller 15) are exposed (see FIG. 16). Though not shown, at the left sidewall of the developing casing 90, the left end portion of the developing roller 6 (specifically, the shaft of the developing roller 6) is exposed. To an upper end of the opening 92 in the developing casing 90, a proximal end portion of a layer-thickness regulating blade 98 is attached. At a distal end portion of the layer-thickness regulating blade 98, a pressing rubber is provided. The pressing rubber presses the surface of the developing roller 6.

In a state in which the developing cartridge 17 is mounted in the process casing 14, a portion of the developing roller 6 exposed through the opening 92 of the developing casing 90 is in contact with the photosensitive drum 3. The developer discharged to the second region 95 through the communicating hole 96 is supplied from the supply roller 15 to the developing roller 6 through the nip. The developer supplied to the developing roller 6 enters between the pressing rubber of the layer-thickness regulating blade 98 and the surface of the developing roller 6, becomes a thin layer having a predetermined thickness, and is carried on the surface of the developing roller 6. The developer carried on the developing roller visualizes the electrostatic latent image on the photosensitive drum 3, as described above.

Portions at the developing sidewall 91 corresponding to the first region 94 and the supply roller 15 are swollen downward in an arc shape according to the shapes of the first region 94 and the supply roller 15, respectively.

As shown in FIG. 16, the third electrode 83 is provided at the right surface of the right sidewall in the developing casing 90 of the developing cartridge 17 on the front side with respect to the supply roller 15. The third electrode 83 is electrically connected to the developing roller 6.

When the developing cartridge 17 is mounted in the process casing 14, first, the developing cartridge 17 is held such that the developing roller 6 is located at the lower end. Next, the developing cartridge 17 is lowered and pressed into the second space 29 through the first opening 38 of the process casing 14 (see FIG. 2B). At this time, the right end portion of the developing roller 6 is received into the guide groove 37 of the fifth process wall 34 in the process casing 14 (see FIG. 2A), and the left end portion of the developing roller 6 is received into the guide groove 37 of the sixth process wall 35 in the process casing 14 (see FIG. 4). Thereafter, as shown in FIG. 2A, if the developing cartridge 17 is pressed into the second space 29 until the right end portion and the left end portion of the developing roller 6 correspondingly reach the end points 37A of the guide grooves 37, as shown in FIG. 2B, the developing cartridge 17 is housed in the second space 29. Thus, mounting of the developing cartridge 17 in the process casing 14 is completed.

In this state, as described above, a portion exposed through the opening 92 in the developing roller 6 is in contact with the photosensitive drum 3, and the developing sidewall 91 is in contact with the first process wall 30 of the process casing 14. Accordingly, the developing cartridge 17 is positioned in the process casing 14 (specifically, the second space 29). The back portion of the developing sidewall 91 is exposed on the lower side through the second opening 39 of the first process wall 30. In addition, as described above, the fourth electrode 84 of the process casing 14 is in contact with the third electrode 83 (see FIG. 2A).

(Body Casing)

Figure 17:
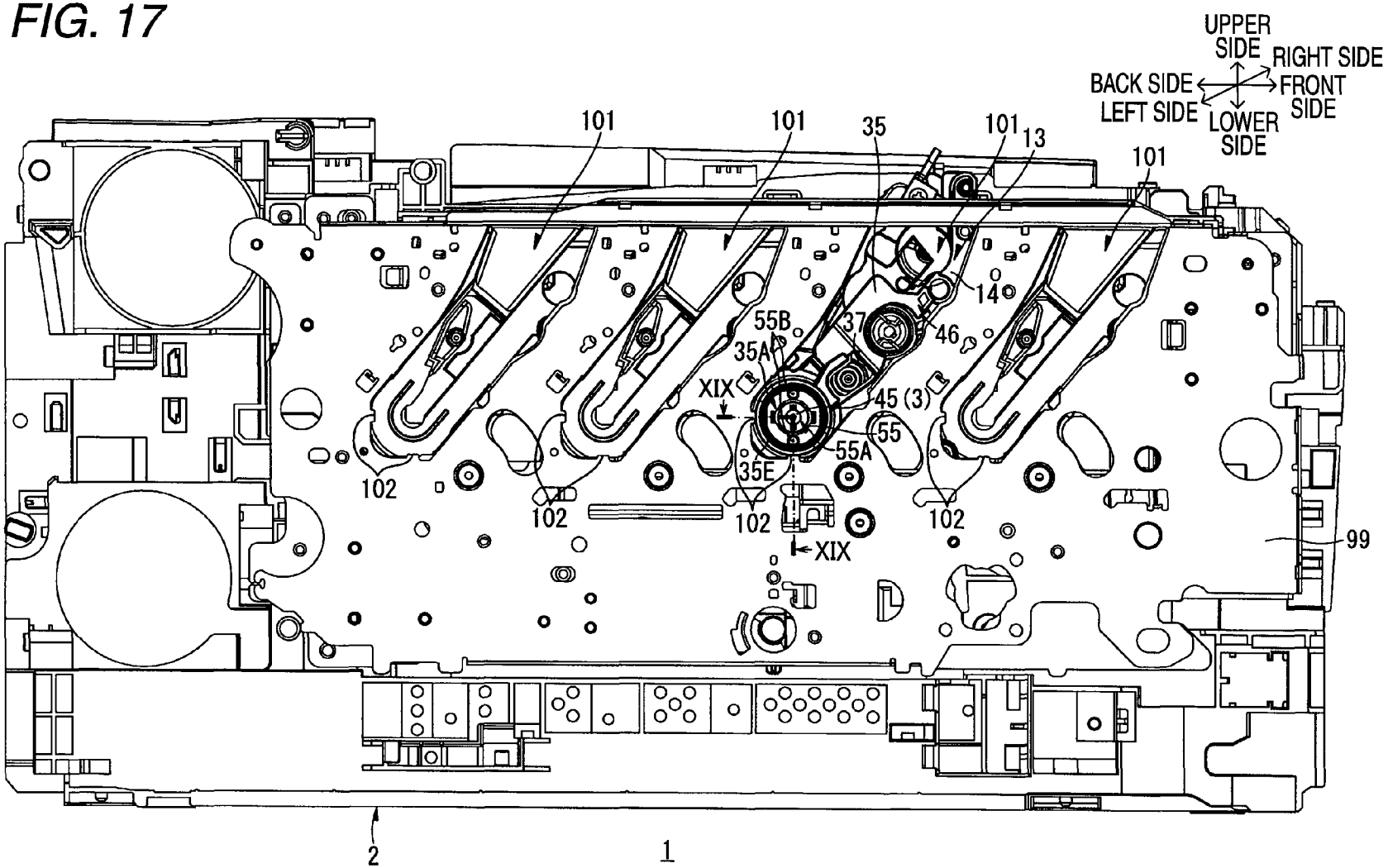
FIG. 17 is a left side section view of the image forming apparatus of FIG. 1, at a position where a left surface of a process cartridge can be viewed.
Figure 18:
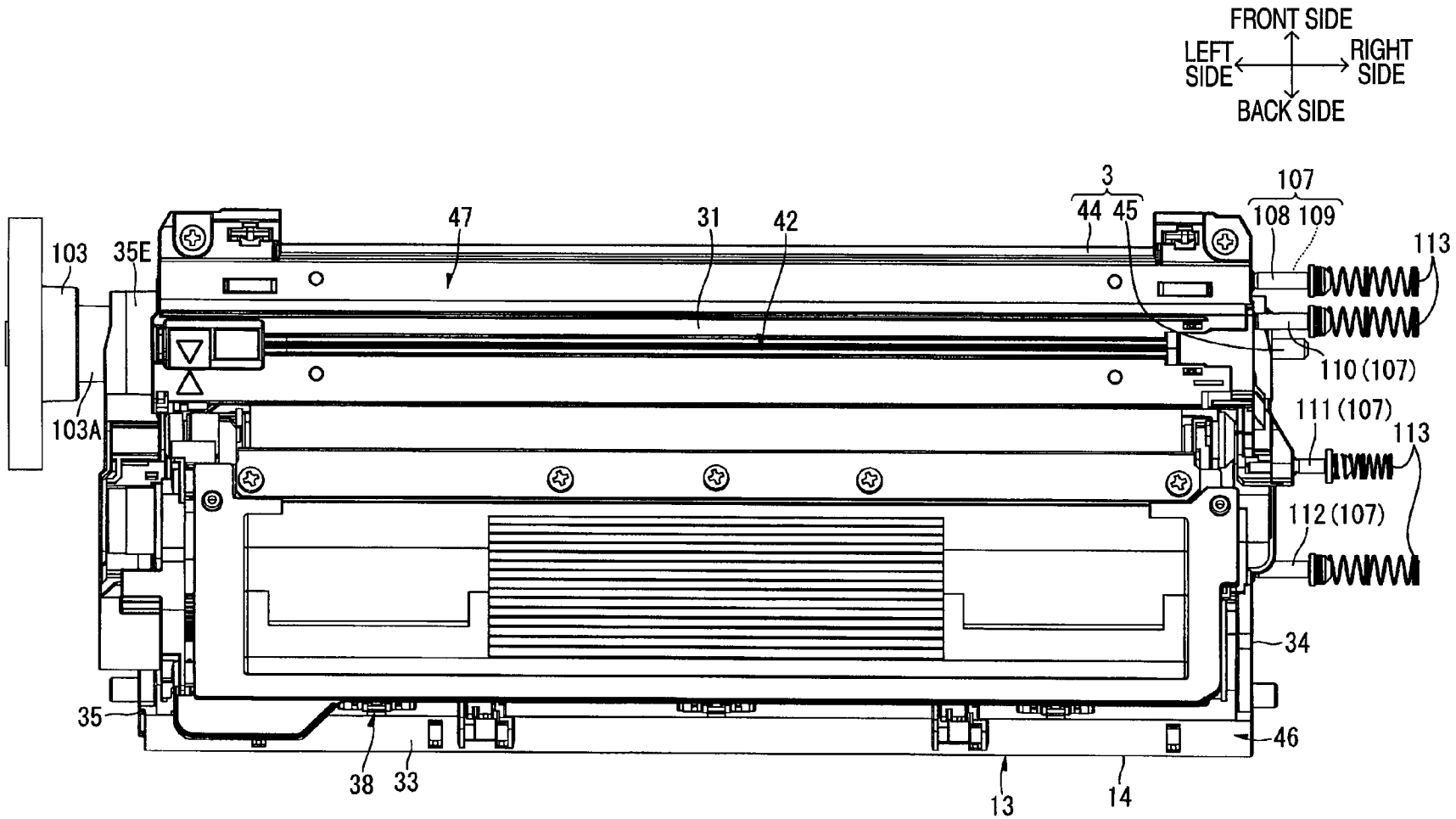
FIG. 18 is a diagram the periphery of the process cartridge in FIG. 17 as viewed from above.

FIG. 17 is a left side sectional view of the image forming apparatus at a position in which the left surface of the process cartridge can be viewed. FIG. 18 is a diagram of the periphery of one of the process cartridges in FIG. 17 as viewed from the above. FIG. 19 is a step sectional view taken along the line XIX-XIX of FIG. 17.

As shown in FIG. 19, inside the body casing 2 of the image forming apparatus, a first wall 99 and a second wall 100 are provided to be opposed to each other and to sandwich the process cartridge 13 mounted in the body casing 2. In FIG. 18, the cover 75, the first wall 99, and the second wall 100 are omitted.

(1) First Wall

As shown in FIG. 17, in the first wall 99, an outer peripheral surface (a left surface) in the widthwise direction is formed of a metal plate. At the first wall 99, a plurality of guide grooves 101 are formed. In this exemplary embodiment, four guide grooves 101 are formed to correspond to the four process cartridges 13. The four guide grooves 101 are formed in parallel along the front-back direction. The guide groove 101 is formed by cutting the first wall 99 from its upper end toward the obliquely lower back side. An innermost portion (lower end portion) of the guide groove 101 is substantially located at the center portion of the first wall 99 in the up-down direction. When the process cartridge 13 is attached to or removed from the body casing 2, the boss 35E of the process casing 14 is guided by the guide groove 101.

In the first wall 99, a portion corresponding to the innermost portion of the guide groove 101, a plurality of convex portions are formed. In this exemplary embodiment, two convex portions are formed, and serve as positioning convex portions 102. One positioning convex portion 102 protrudes upward inside of the guide groove 101, and the other positioning convex portion 102 protrudes forward inside of the guide groove 101. When the process cartridge 13 is mounted in the body casing 2, the boss 35E of the process casing 14 comes in contact with the two convex portions 102. Accordingly, the process cartridge 13 is positioned in the body casing 2. In this state, in the boss 35E, the left exposure hole 35A of the process casing 14 and the left end surface of the driving force receiving portion 55 are exposed on the right side with respect to the first wall 99 through the innermost portion of the guide groove 101.

In a portion corresponding to the innermost portion of the guide groove 101 in the first wall 99, a driving force transmitting portion 103 shown in FIG. 19 is provided.

The driving force transmitting portion 103 substantially has a cylindrical shape, and a center axis of the driving force transmitting portion 103 extends along the widthwise direction. Specifically, the driving force transmitting portion 103 is reduced in diameter in a steplike manner toward the right side, and a right end portion 103A of the driving force transmitting portion 103 has a size to an extent so as to be fitted into the boss 35E of the process casing 14. The driving force transmitting portion 103 is connected to an output shaft of a motor (not shown) provided in the body casing 2, and is rotated when the motor is driven.

The driving force transmitting portion 103 freely slides in the right-left direction, and if the process cartridge 13 is mounted in the body casing 2, is pressed to the right side by a press mechanism (not shown). Accordingly, the driving force transmitting portion 103 is fitted into the boss 35E of the process casing 14, and substantially presses the left end surface of the driving force receiving portion 55 (specifically, the protrusion 55B) to the right side (see a direction M indicated by a thick solid-line arrow) in the horizontal direction. Then, as described above, the photosensitive drum 3 is relatively movable in the widthwise direction with respect to the process casing 14. For this reason, the drum body 44, the left flange 48, and the right flange 49, which are made as a single body with the driving force receiving portion 55, are moved to the right side in a state where the left flange 48 is supported by the left bearing 50 and the right flange 49 is supported by the right bearing 51. Accordingly, the right flange 49 presses the right bearing 51 at the convex portion 51C to the right side, and the drum shaft 45 and the fastener 54, which are made as a single body with the right bearing 51, are moved. That is, when the driving force transmitting portion 103 is pressed against the driving force receiving portion 55, the photosensitive drum 3 (the drum body 44, the drum shaft 45, the left flange 48, the right flange 49, and the driving force receiving portion 55), the fastener 54, and the right bearing 51 are moved to the right side.

In a portion of the second wall 100 opposed to the right bearing 51 in the widthwise direction, a rib 104 is provided to protrude to the left side. As described above, if the right end portion of the right bearing 51, which is moved to the right side, is in contact with the rib 104, the movement of the photosensitive drum 3, the fastener 54, and the right bearing 51 to the right side is stopped. Accordingly, the photosensitive drum 3, the fastener 54, and the right bearing 51 come in contact with the second wall 100 of the body casing 2 as a single body, and are positioned in the widthwise direction by the second wall 100.

The right end portion of the right bearing 51 in contact with the rib 104 becomes a first contact portion 105. At the second wall 100, a hole 100A, into which the drum shaft 45 is loosely fitted, is formed. The portion of the drum shaft 45 on the right side with respect to the right bearing 51 is disposed so as not to interfere with the second wall 100.

(2) Second Wall

In the body casing 2, a bias supply source (not shown) is provided.

At the second wall 100, a body electrode 107 is provided. The body electrode 107 is provided to correspond to the process cartridge 13, and is connected to the bias supply source (not shown).

As shown in FIG. 18, the body electrode 107 includes a first body electrode 108, a second body electrode 109, a third body electrode 110, a fourth body electrode 111, and a fifth body electrode 112. In FIG. 18, the second body electrode 109 is hidden behind the first body electrode 108. Each of the body electrodes (i.e., the first through fifth electrodes) is pressed to the left side by a press member 113, such as a coil spring.

As shown in FIG. 19, in the second wall 100, a through hole 106 is formed at a position opposed to the right surface of the process cartridge 13. The first body electrode 108, the second body electrode 109, the third body electrode 110, the fourth body electrode 111, and the fifth body electrode 112 (see FIG. 18) pressed by the press member 113 are exposed at the right surface of the second wall 100 through the corresponding through holes 106.

The first body electrode 108 shown in FIG. 18 is in contact with the cleaning shaft electrode 87 (see FIG. 2A) and presses the cleaning shaft electrode 87 to the left side. The second body electrode 109 is in contact with the cleaning roller electrode 86 (see FIG. 2A) and presses the cleaning roller electrode 86 to the left side. The third body electrode 110 is in contact with the grid electrode 88 (see FIG. 2A) and presses the grid electrode 88 to the left side. The fourth body electrode 111 is in contact with the wire electrode 89 (see FIG. 2A) and presses the wire electrode 89 to the left side. The fifth body electrode 112 is in contact with the fourth electrode 84 (see FIG. 2A) and presses the fourth electrode 84 to the left side. For convenience of explanation, FIG. 19 only shows a case in which the first body electrode 108 presses the cleaning shaft electrode 87 to the left side.

As described above, the grid electrode 88 and the wire electrode 89 are included in the first electrode 81, and the cleaning roller electrode 86 and the cleaning shaft electrode 87 are included in the second electrode 82. That is, the body electrode 107 substantially presses the cartridge electrode 80 (the first electrode 81, the second electrode 82, and the fourth electrode 84) to the left side (a direction N indicated by a thick dotted-line arrow) along the horizontal direction. Accordingly, the cartridge electrode 80 and the body electrode 107 are electrically connected with each other, and a bias is supplied from a bias supply source (not shown) to the cartridge electrode 80 through the body electrode 107.

If the cartridge electrode 80 is pressed by the body electrode 107 toward the left side, the process casing 14 for supporting the cartridge electrode 80 is moved to the left side. In this case, as described above, the photosensitive drum 3 is relatively movable in the widthwise direction with respect to the process casing 14. Therefore, as described above, the process casing 14 is relatively moved to the left side with respect to the right bearing 51 and the photosensitive drum 3, which are in contact with the second wall 100. Then, if the left sidewall (the sixth process wall 35) of the process casing 14 being moved to the left side is in contact with the first wall 99, the movement of the process casing 14 to the left side is stopped. Therefore, the process casing 14 is positioned in the widthwise direction by the first wall 99 of the body casing 2.

As such, the direction N in which the body electrode 107 is pressed against the cartridge electrode 80 substantially progresses toward the left side along the horizontal direction. Further, the direction M in which the driving force transmitting portion 103 is pressed against the driving force receiving portion 55 substantially progresses toward the right side along the horizontal direction. That is, the direction N in which the body electrode 107 is pressed against the cartridge electrode 80 is in parallel with and opposite to the direction M in which the driving force receiving portion 55 is pressed against the driving force transmitting portion 103.

In the process cartridge 13, as shown in FIG. 18, one axial end portion (left end portion) of the photosensitive drum 3 is rotatably supported by the left bearing 50, and the other axial end portion (right end portion) of the photosensitive drum 3 is rotatably supported by the right bearing 51. In addition, in a state where the process cartridge 13 is mounted in the body casing 2, the driving force receiving portion 55, which is provided in the left end portion of the photosensitive drum 3, is connected to the driving force transmitting portion 103 in the body casing 2. Thus, the driving force for driving the photosensitive drum 3 is transmitted from the driving force transmitting portion 103 to the driving force receiving portion 55. At this time, the driving force receiving portion 55 is pressed against the driving force transmitting portion 103, and accordingly the first contact portion 105 of the right bearing 51 is in contact with the body casing 2 (the second wall 100). Therefore, the photosensitive drum 3 which is supported by the right bearing 51 is directly positioned in the body casing 2, without passing through the process casing 14 of the process cartridge 13.

As a result, it is possible to stabilize the relative position of the photosensitive drum 3 and the body casing 2.

The photosensitive drum 3 and the process casing 14 are moved separately and are relatively movable. With this configuration, when the driving force receiving portion 55 of the photosensitive drum 3 is pressed against the driving force transmitting portion 103, the photosensitive drum 3 can be moved such that the first contact portion 105 can be in contact with the body casing 2, while the movement of the process casing 14 can be restricted by pressing of the driving force transmitting portion 103.

When the cartridge electrode 80 (also see FIG. 2A), which is provided in the process casing 14, is pressed against the body electrode 107 (also see FIG. 17) of the body casing 2, bias is supplied from the bias supply source (not shown) of the body casing 2. In addition, the sixth process wall 35 of the process casing 14 is in contact with the body casing 2 (the first wall 99) by pressing of the cartridge electrode 80. Therefore, the processing casing 14 is positioned in the printer 1.

In this case, the direction N in which the body electrode 107 presses the cartridge electrode 80 is parallel to the direction M in which the driving force transmitting portion 103 presses the driving force receiving portion 55. Therefore, an external force that is applied to the process cartridge 13 can be concentrated, as compared with a case where the directions are not in parallel to each other. As a result, it is possible to stabilize the posture of the process cartridge 13.

The body casing 2 has the first wall 99 and the second wall 100 that are opposed to each other with the process cartridge 13 sandwiched therebetween. The driving force transmitting portion 103 is provided in the first wall 99, and the body electrode 107 is provided in the second wall 100. In addition, the direction N in which the body electrode 107 presses the cartridge electrode 80 is opposite to the direction M in which the driving force transmitting portion 103 presses the driving force receiving portion 55. Therefore, the pressing force of the body electrode 107 against the cartridge electrode 80 and the pressing force of the driving force transmitting portion 103 against the driving force receiving portion 55 can be balanced. As a result, it is possible to cancel an external force that is applied to the process cartridge 13, and thus it is possible to further stabilize the posture of the process cartridge 13.

As shown in FIG. 2A, the cartridge electrode 80 includes at least one of the first electrode 81 for supplying bias to the charger 4, the second electrode 82 for supplying bias to the cleaning member 18, and the fourth electrode 84 connected to the third electrode 83 for supplying bias to the developing cartridge 17. For this reason, if the body electrode 107 presses at least one of the first electrode 81, the second electrode 82, and the fourth electrode 84, as shown in FIG. 18, the sixth process wall 35 can be reliably in contact with the body casing 2 (the first wall 99).

The right bearing 51 rotatably supports the right flange 49, which is attached to the right end portion of the photosensitive drum 3, thereby supporting the right end portion of the photosensitive drum 3 through the right flange 49. Therefore, the photosensitive drum 3 can be prevented from being in contact with the right bearing 51 and damaged.

As shown in FIGS. 8A to 9B, the third convex portion 50D of the left bearing 50 is engaged with the first casing 46 of the processing casing 14 (specifically, the left rib 35B) by rotating the left bearing 50 in the first direction A. Therefore, the left bearing 50 can be easily positioned in the process casing 14. In addition, as shown in FIG. 9B, in a state where the third convex portion 50D is engaged with the first casing 46, the contacted portion 50F of the left bearing 50 is in contact with the second casing 47 (specifically, the left contact portion 47A). Therefore, the movement of the left bearing 50 can be regulated, and the state where the third convex portion 50D is engaged with the first casing 46 can be maintained. As a result, the left bearing 50 can be stably positioned in the process casing 14.

In a state where the third convex portion 50D is engaged with the first casing 46, the left rib 35B of the first casing 46 (specifically, the first portion 35C) regulates the rotation of the left bearing 50 in the first direction A, and the left contact portion 47A of the second casing 47 regulates the rotation of the left bearing 50 in a direction opposite to the first direction A. Therefore, the state whether the third convex portion 50D is engaged with the first casing 46 can be reliably maintained. As a result, the left bearing 50 can be stably positioned in the process casing 14.

As shown in FIG. 6, the second casing 47 (specifically, the left contact portion 47A and the right contact portion 47B) supporting the charger 4 is in contact with the left bearing 50 supporting the left end portion of the photosensitive drum 3 and the right bearing 51 supporting the right end portion of the photosensitive drum 3. Therefore, it is possible to stabilize the relative position of the charger 4 and the photosensitive drum 3. As a result, the charger 4 can accurately charge the photosensitive drum 3.

(Modified Exemplary Embodiments)

The above-described exemplary embodiments of the inventive concept have been described in relation to a so-called direct transfer type color printer in which the developer images on the surfaces of the individual photosensitive drums 3 are directly transferred to the sheet P. Alternatively, the invention may be applied to an intermediate transfer type color printer or monochrome printer in which the developer images on the individual photosensitive drums 3 are temporarily transferred to an intermediate transfer member and are then transferred to the sheet P in a batch manner.

In the above-described exemplary embodiments, the photosensitive drum 3 is exposed by the LED. In addition, the invention may be applied to a laser printer in which the photosensitive drum 3 is exposed by laser.

While the present invention has been shown and described with reference to certain exemplary embodiments thereof, it will be understood by those skilled in the art that various changes in form and details may be made therein without departing from the spirit and scope of the invention as defined by the appended claims.

What is claimed is:

1. An image forming apparatus comprising:

an image forming apparatus body comprising a driving force transmitting portion; and a process cartridge that is configured to be removably mounted to the image forming apparatus body, wherein the process cartridge comprises:

a housing;

a photosensitive drum disposed in the housing;

a first bearing configured to rotatably support a first axial end portion of the photosensitive drum and permit movement of the photosensitive drum in an axial direction of the photosensitive drum;

a driving force input portion provided on the first axial end portion of the photosensitive drum and configured to engage the driving force transmitting portion in the axial direction of the photosensitive drum, wherein the driving force input portion is further configured to receive a driving force transmitted from the driving force transmitting portion in response to the driving force transmitting portion pressing against the driving force input portion and drive the photosensitive drum using the driving force; and a second bearing configured to rotatably support a second axial end of the photosensitive drum and permit movement of the photosensitive drum in the axial direction, wherein the second bearing comprises a contact portion configured to contact the image forming apparatus body in response to the driving force transmitting portion pressing against the driving force input portion.

2. The image forming apparatus according to claim 1, wherein the photosensitive drum is movable separately within the housing of the process cartridge, and the photosensitive drum and the housing are relatively movable with respect to each other.

3. The image forming apparatus according to claim 1,
wherein the image forming apparatus body further comprises:
a body electrode that is connected to a bias supply source,
wherein the housing comprises:
a cartridge electrode that is configured to contact the body electrode to receive a bias from the bias supply source when the body electrode is pressed against the cartridge electrode; and
a second contact portion that is configured to contact the image forming apparatus body when the body electrode is pressed against the cartridge electrode, and
wherein a direction in which the body electrode presses the cartridge electrode is parallel to a direction in which the driving force transmitting portion presses the driving force input portion.

4. The image forming apparatus according to claim 3,
wherein the image forming apparatus body further comprises a first wall comprising the driving force transmitting portion, and a second wall comprising the body electrode, the first wall and the second wall being opposed to each other with the process cartridge sandwiched therebetween, and
wherein a direction in which the body electrode presses the cartridge electrode is opposite to a direction in which the driving force transmitting portion presses the driving force input portion.

5. The image forming apparatus according to claim 3, further comprising:
a charger supported by the housing to charge the photosensitive drum;
a first electrode provided in the housing to supply a bias to the charger;
a cleaning member that is supported by the housing and is configured to catch foreign substances from the photosensitive drum;
a second electrode provided in the housing to supply a bias to the cleaning member;
a developing cartridge that is removably mounted in the housing and provides developer to the photosensitive drum;
a third electrode provided in the developing cartridge to supply bias to the developing cartridge; and
a fourth electrode that is provided in the housing and is in contact with the third electrode,
wherein the cartridge electrode comprises at least one of the first electrode, the second electrode and the fourth electrode.

6. The image forming apparatus according to claim 5,
wherein the photosensitive drum comprises a flange attached to the other axial end portion of the photosensitive drum, and
wherein the second bearing rotatably supports the flange.

7. The image forming apparatus according to claim 5,
wherein the housing comprises a first housing and a second housing, and
wherein the first bearing comprises:
an engaging portion that is configured to engage with the first housing by rotating the first bearing in a first direction; and
a contacted portion that is in contact with the second housing in a state in which the engaging portion is engaged with the first housing.

8. The image forming apparatus according to claim 7,
wherein the first housing comprises a first regulating portion that regulates the rotation of the first bearing in the first direction in a state in which the engaging portion is engaged with the first housing, and
wherein the second housing comprises a second regulating portion that regulates the rotation of the first bearing in a direction opposite to the first direction in a state in which the engaging portion is engaged with the first housing.

9. The image forming apparatus according to claim 7, wherein the second housing supports the charger and is in contact with the first bearing and the second bearing.

10. A process cartridge for use in an image forming apparatus, the process cartridge comprising:
a housing;
a photosensitive drum disposed in the housing;
a first bearing provided at a first axial end portion of the photosensitive drum and configured to rotatably support the first axial end portion of the photosensitive drum;
a driving force input portion provided on the first axial end portion of the photosensitive drum, wherein the driving force input portion is configured to receive a driving force transmitted from the image forming apparatus and drive the photosensitive drum using the driving force; and
a second bearing provided at a second axial end of the photosensitive drum and configured to rotatably support the photosensitive drum, wherein the second bearing comprises a contact portion configured to be pressed by the image forming apparatus in response to the received driving force.

11. The process cartridge according to claim 10, wherein the photosensitive drum is movable separately within the housing of the process cartridge, and the photosensitive drum and the housing are relatively movable with respect to each other.

12. The image forming apparatus according to claim 1, wherein the driving force input portion is integrally provided with the photosensitive drum.

* * * * *